US007992980B2

(12) United States Patent
Umeda

(10) Patent No.: US 7,992,980 B2
(45) Date of Patent: Aug. 9, 2011

(54) LIQUID EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 379 days.

(21) Appl. No.: 12/198,115

(22) Filed: Aug. 25, 2008

(65) Prior Publication Data

US 2009/0058899 A1 Mar. 5, 2009

(30) Foreign Application Priority Data

Aug. 31, 2007 (JP) ..... 2007-225734

(51) Int. Cl.
*B41J 2/175* (2006.01)
*B41J 2/19* (2006.01)

(52) U.S. Cl. ..... 347/85; 347/92

(58) Field of Classification Search ..... 347/30, 347/36, 85, 92
See application file for complete search history.

(56) References Cited

U.S. PATENT DOCUMENTS

| | | | | |
|---|---|---|---|---|
| 6,224,201 | B1 | 5/2001 | Shigemura | |
| 7,303,271 | B2 | 12/2007 | Shimizu et al. | |
| 2006/0048647 | A1 | 3/2006 | Iwata | |
| 2006/0050112 | A1 | 3/2006 | Moynihan | |
| 2006/0137526 | A1 | 6/2006 | Ueda | |
| 2007/0046747 | A1 * | 3/2007 | Takemoto | 347/92 |

FOREIGN PATENT DOCUMENTS

| | | | |
|---|---|---|---|
| JP | S63-145039 | A | 6/1988 |
| JP | 2005-145045 | A | 6/2005 |
| JP | 2005-288770 | A | 10/2005 |
| JP | 2006-206190 | A | 8/2006 |

OTHER PUBLICATIONS

European Patent Office, European Search Report for European Patent Application No. 08014986 (counterpart to above-captioned patent application), dated Dec. 18, 2008.

* cited by examiner

*Primary Examiner* — Geoffrey Mruk
(74) *Attorney, Agent, or Firm* — Baker Botts L.L.P.

(57) ABSTRACT

There is disclosed a liquid ejecting apparatus including a liquid ejecting head having a nozzle and ejecting a liquid from the nozzle, a liquid supply passage which is connected with the liquid ejecting head, and through which the liquid is supplied to the liquid ejecting head, a gas discharge passage which is connected with the liquid supply passage at two different places, and through which a gas in the liquid supply passage is discharged, a gas-permeable film which is disposed at one of the two different places, constitutes a wall which separates the liquid supply passage and the gas discharge passage from each other, and allows gases to pass therethrough but does not allow liquids to pass therethrough, a shut-off valve which is disposed at the other of the two different places, and selectively placeable in an open state to communicate the liquid supply passage and the gas discharge passage with each other and a closing state to disconnect the communication between the liquid supply passage and the gas discharge passage, and a sucking device which lowers an internal pressure of the gas discharge passage by sucking the gas from the gas discharge passage.

10 Claims, 16 Drawing Sheets

LIQUID EJECTING APPARATUS

CROSS REFERENCE TO RELATED APPLICATION

The present application claims priority from Japanese Patent Application No. 2007-225734, which was filed on Aug. 31, 2007, the disclosure of which is herein incorporated by reference in its entirety.

BACKGROUND OF THE INVENTION

1. Field of the Invention

The present invention relates to a liquid ejecting apparatus having a nozzle and ejecting a liquid from the nozzle.

2. Description of Related Art

An inkjet recording apparatus disclosed in JP-A-2005-288770 includes a recording head, a cap, and an ink sucking device. A nozzle is open in a surface of a nozzle plate that constitutes the recording head, and the cap covers the surface of the nozzle plate. The ink sucking device sucks ink in the recording head. More specifically, while the surface of the nozzle plate is covered by the cap, the ink sucking device is operated, whereby the ink whose viscosity has increased and others inside the recording head are discharged through the nozzle. The inkjet recording apparatus further includes a sub tank storing the ink to be supplied to the recording head. A gas-permeable film is disposed in the sub tank and vertically divides an internal space of the sub tank into two smaller spaces, namely, an upper space and a lower space. The lower space functions as an ink chamber (liquid supply passage) for storing the ink, and the upper space functions as a gas chamber (gas discharge passage) to which a gas or air contained in the ink chamber is discharged. The gas chamber is connected with a gas or air suction pump via a valve operated by a controller. The gas or air in the gas and ink chambers is discharged to the external by the gas suction pump operated while the valve is held open so as to suck the gas or air from the gas chamber. By thus discharging the ink with the increased viscosity and the gas or air to the external, the inkjet recording apparatus is free from undesirable variation in the ink ejection performance, or the characteristics in ejection of ink droplets from the nozzle, which may be otherwise caused by increase in the ink viscosity and the gas or air present in the recording head.

However, the inkjet recording apparatus has a disadvantage that when the ink is thus discharged from the nozzle, the nozzle may be clogged with the ink with the increased viscosity.

SUMMARY OF THE INVENTION

This invention has been developed in view of the above-described situations, and it is an object of the invention, therefore, to provide a liquid ejecting apparatus that includes a liquid ejecting head and is capable of discharging a liquid whose viscosity has increased, from an inside of the liquid ejecting head, with stability and without causing clogging of a nozzle.

To attain the above object, the invention provides a liquid ejecting apparatus including a liquid ejecting head, a liquid supply passage, a gas discharge passage, a gas-permeable film, a shut-off valve, and a sucking device. The liquid ejecting head has a nozzle and ejects a liquid from the nozzle. The liquid supply passage is connected with the liquid ejecting head, and the liquid is supplied to the liquid ejecting head through the liquid supply passage. The gas discharge passage is connected with the liquid supply passage at two different places, and a gas in the liquid supply passage is discharged through the gas discharge passage. The gas-permeable film is disposed at one of the two different places and constitutes a wall that separates the liquid supply passage and the gas discharge passage from each other. The gas-permeable film allows gases to pass therethrough, but does not allow liquids to pass therethrough. The shut-off valve is disposed in the other of the two different places, and is selectively placeable in an open state to communicate the liquid supply passage and the gas discharge passage with each other and a closing state to disconnect the communication between the liquid supply passage and the gas discharge passage. The sucking device lowers an internal pressure of the gas discharge passage by sucking the gas from the gas discharge passage.

According to the liquid ejecting apparatus, the liquid with an increased viscosity in the liquid supply passage can be discharged through the gas discharge passage via the shut-off valve, by operating the sucking device so as to lower the internal pressure of the gas discharge passage while the shut-off valve is in the open state. When the liquid with the increased viscosity is discharged in this way, a path along which the liquid is discharged does not include the nozzle. Hence, the nozzle is not clogged with the liquid whose viscosity has been increased and is relatively high.

On the other hand, the gas in the liquid supply passage can be discharged through the gas discharge passage via the gas-permeable film, by operating the sucking device so as to lower the internal pressure of the gas discharge while the shut-off valve is in the closing state.

Preferably, the liquid ejecting apparatus is such that the liquid supply passage is connected with the liquid ejecting head and includes a liquid storage tank for temporarily storing the liquid that is to be supplied to the liquid ejecting head, and the two different places are disposed in the liquid storage tank.

According to the preferable form, the liquid storage tank is larger in dimensions or volume than the other portions of the liquid supply passage. Thus, the liquid storage tank contains a larger amount of the gas and the ink with the increased viscosity, than the other portions of the liquid supply passage. Hence, by connecting the gas discharge passage with the liquid supply passage at two different places in the liquid storage tank, the gas and the ink with the increased viscosity that are in the liquid supply passage can be discharged with high efficiency.

The liquid storage tank is larger in dimensions than the other portions of the liquid supply passage. Hence, by connecting the gas discharge passage with the liquid storage tank at two different places in the liquid storage tank, each of the two different places where the gas discharge passage and the liquid supply passage are connected with each other can be made relatively large in dimensions, and the dimensions of the gas-permeable film and the shut-off valve that are disposed at the two different places, respectively, can be made accordingly large. Thus, the gas in the liquid supply passage can be efficiently discharged through or via the gas-permeable film, as well as the liquid with the increased viscosity in the liquid supply passage can be efficiently discharged through or via the shut-off valve.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 7A shows a state where the shut-off valve is in its closing position, and FIG. 7B shows a state where the shut-off valve is in an opening position;

DETAILED DESCRIPTION OF PREFERRED EMBODIMENTS

Hereinafter, there will be described one presently preferred embodiment of the invention, by referring to the accompanying drawings.

Figure 1:
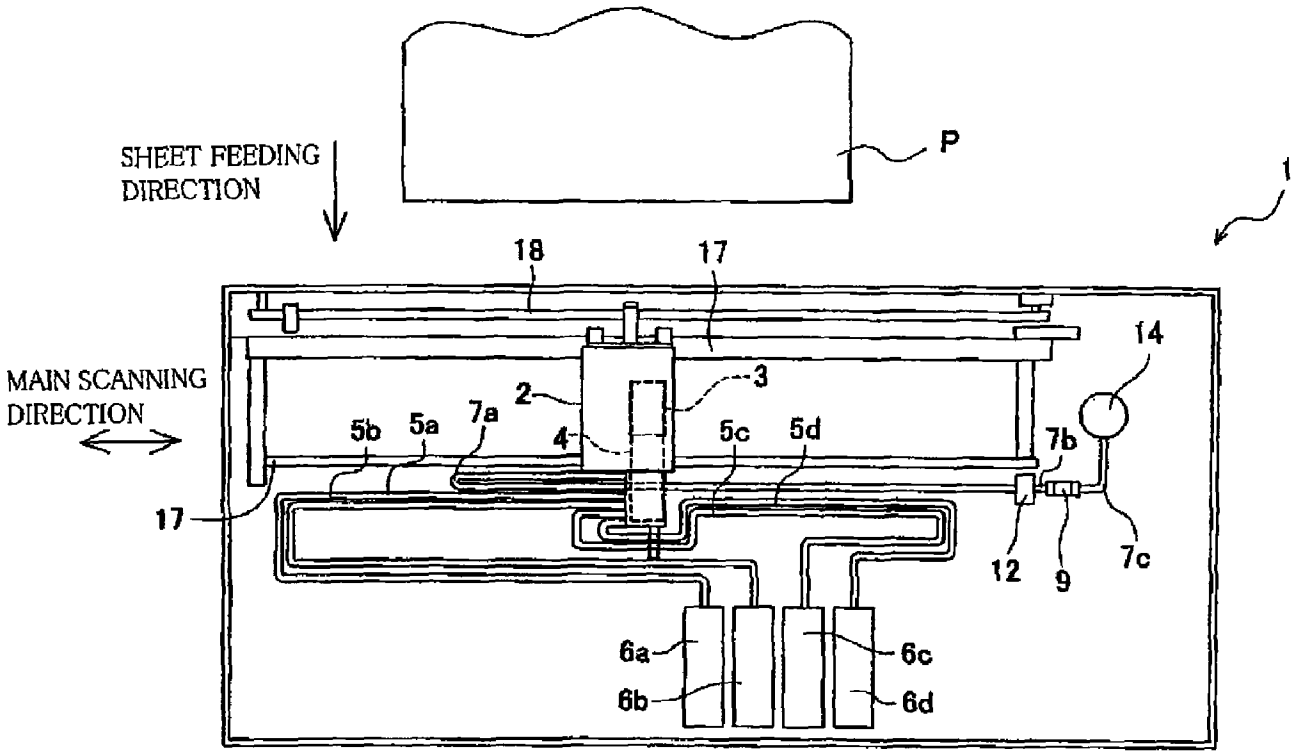
FIG. 1 is a schematic view of a printer as one embodiment of the invention.

Referring first to FIG. 1, reference numeral 1 generally denotes a printer as one embodiment of the invention. The printer 1 includes a carriage 2, an inkjet head 3, a sub tank 4 (as a liquid storage tank), ink tubes 5*a*-5*d*, ink cartridges 6*a*-6*d*, air tubes 7*a*-7*c*, a differential pressure valve 9, a charge tank 12, and a suction pump 14. Operations of the printer 1 are controlled by a controller 100.

The carriage 2 is driven by a driving device 18 and reciprocated in a main scanning direction along two guide shafts 17 extending parallel to each other in a left-right direction as seen in FIG. 1. The inkjet head 3 is mounted on the carriage 2, and has nozzles 95 (shown in FIG. 8) open in an under surface of the inkjet head 3. Printing or recording on a recording sheet P is performed as follows. While reciprocated with the carriage 2 in the main scanning direction, the inkjet head 3 ejects from the nozzles 95 ink as a liquid onto the recording sheet P fed by a sheet feeding mechanism (not shown) in a sheet feeding direction that is downward as seen in FIG. 1.

The sub tank 4 is mounted on the carriage 2, and temporarily stores the ink to be supplied to the inkjet head 3. The tubes 5*a*-5*d* may be formed of a synthetic material, for instance. One of two opposite ends of each of the ink tubes 5*a*-5*d* is connected with the sub tank 4, and the other end thereof is connected with one of the ink cartridges 6*a*-6*d*. The ink cartridges 6*a*-6*d* respectively store black, yellow, cyan, and magenta inks, which are supplied to the sub tank 4 through the respective ink tubes 5*a*-5*b*. The inkjet head 3 are thus supplied with the four color inks from the sub tank 4, and ejects droplets of the inks from the nozzles 95.

The air tubes 7*a*-7*c* may be formed of a synthetic material, for instance. The air tube 7*a* connects the sub tank 4 with the charge tank 12, the air tube 7*b* connects the charge tank 12 with the differential pressure valve 9, and the air tube 7*c* connects the differential pressure valve 9 with the suction pump 14. Thus, the sub tank 4 and the suction pump 14 are connected with each other via the air tube 7*a*, the charge tank 12, the air tube 7*b*, the differential pressure valve 9, and the tube 7*c*. It is noted that a gas or air passage extending from an air chamber 49 (shown in FIG. 3) to the suction pump 14 through an air discharge device 23 (shown in FIG. 2 and described later) of the sub tank 4, the air tube 7*a*, the charge tank 12, the air tube 7*b*, the differential pressure valve 9, and the tube 7*c* corresponds to a gas discharge passage.

As fully described later, the differential pressure valve 9 operates to switch a communication state between the air tube 7*b* and the air tube 7*c*, that is, establishes and disconnects communication therebetween. The charge tank 12 functions to prolong a period of time during which negative pressure is maintained in a portion of the gas discharge passage between the sub tank 4 and the differential pressure valve 9 after the internal pressure of the portion is lowered to a negative pressure, as described later.

The suction pump 14 is connected with the tube 7*c*, and operates to suck the air from the gas discharge passage so as to discharge from the sub tank the air and the inks whose viscosities have increased and are relatively high, as fully described later.

Figure 2:
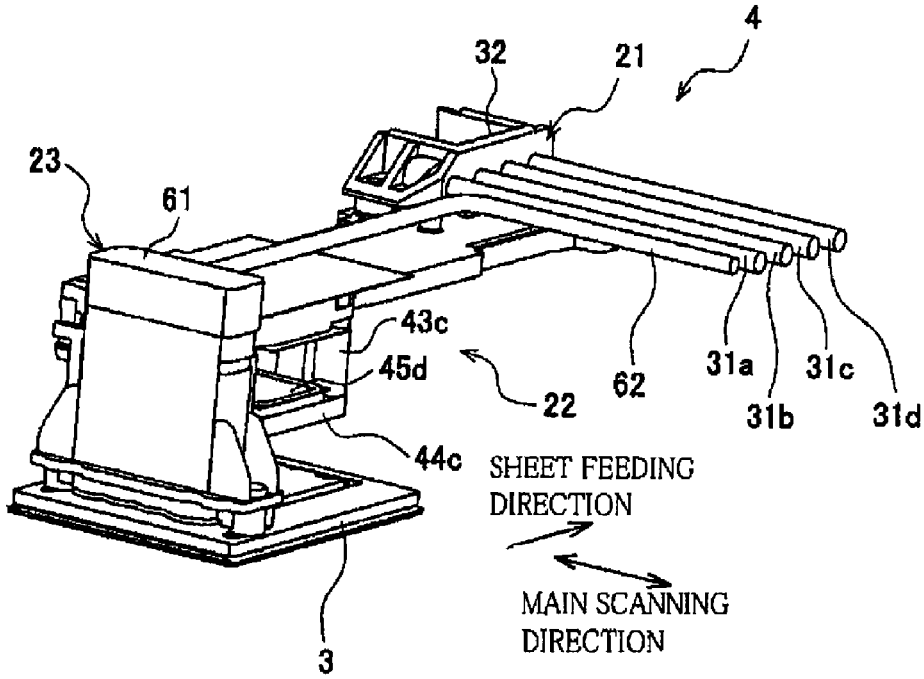
FIG. 2 is a perspective view of a sub tank shown in FIG. 1.
Figure 3:
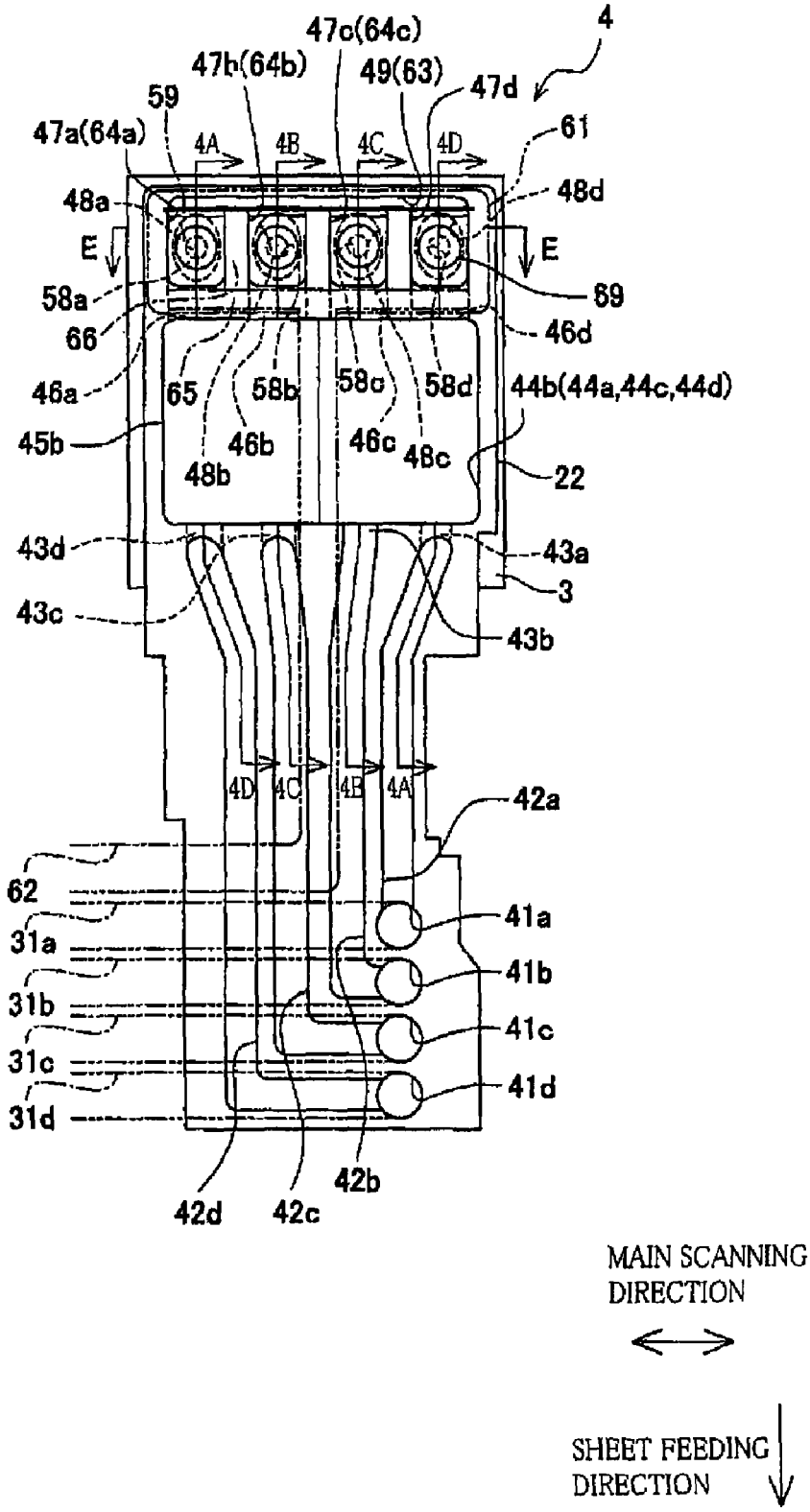
FIG. 3 is a plan view of the sub tank.
Figure 4A:
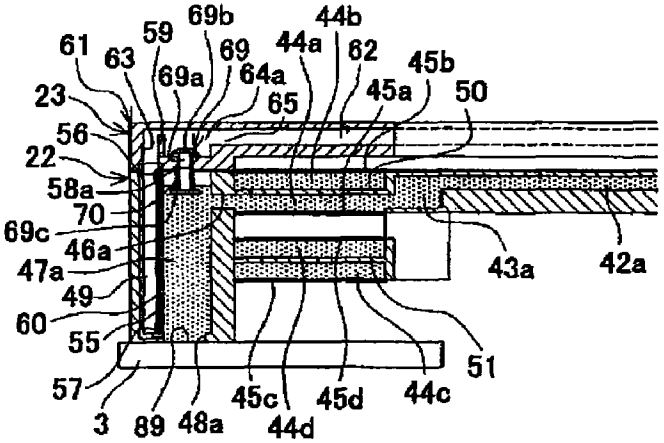
FIGS. 4A-4D are cross-sectional views taken along lines 4A-4A, 4B-4B, 4C-4C and 4D-4D in FIG. 3, respectively.
Figure 4B:
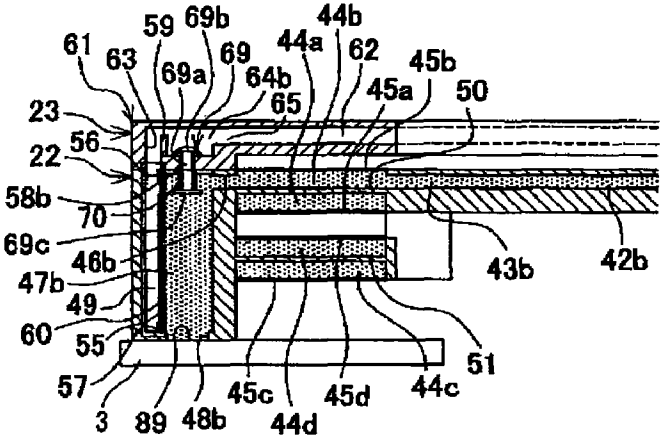
Figure 4C:
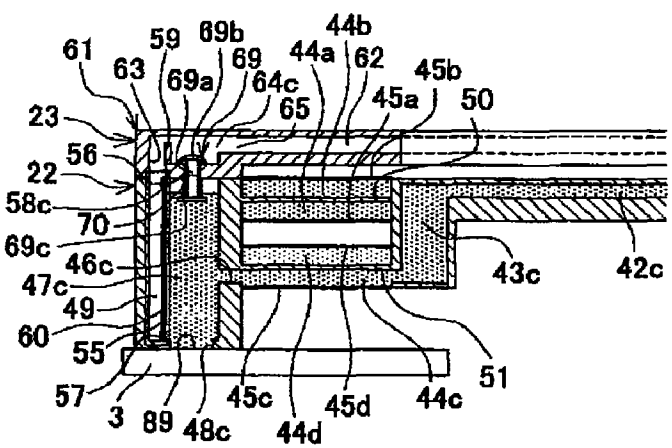
Figure 4D:
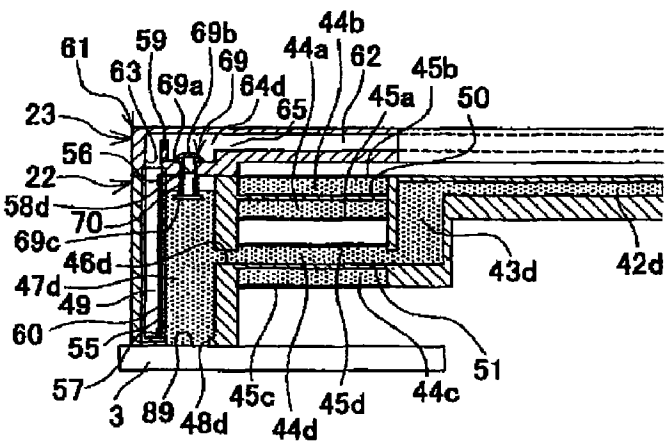
Figure 5:
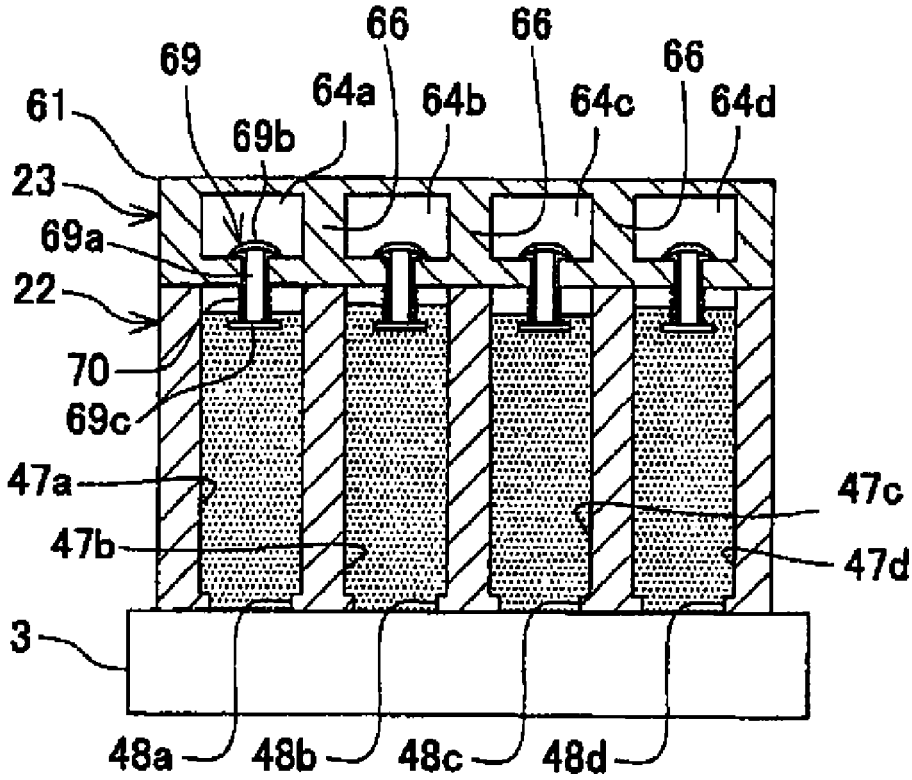
FIG. 5 is a cross-sectional view taken along line 5-5 in FIG. 3.
Figure 6:
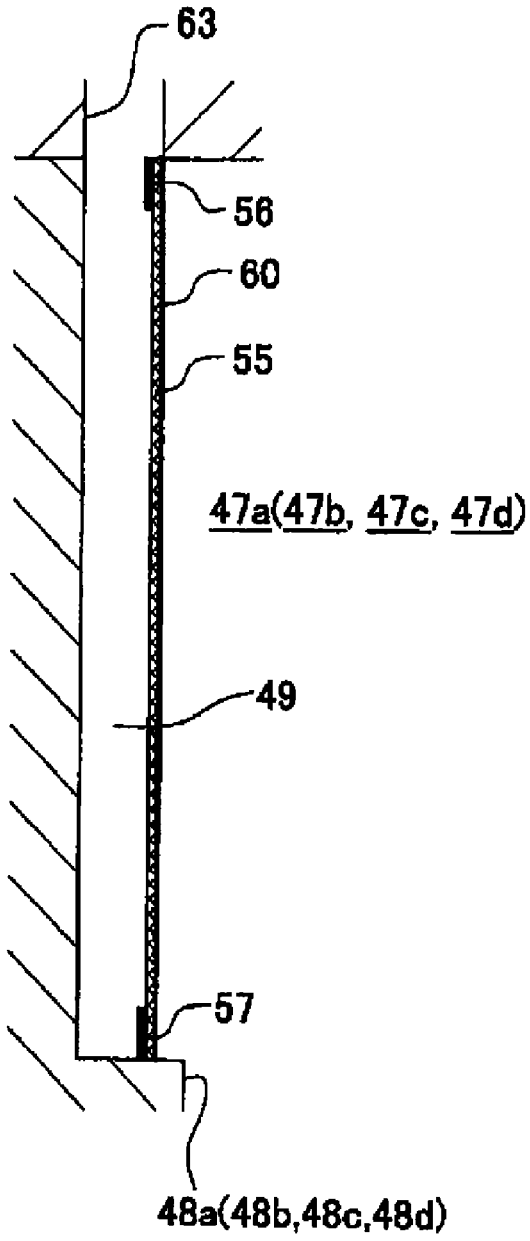
FIG. 6 shows in enlargement a part of FIGS. 4A-4D enclosed by a broken line.

Referring now to FIGS. 2-6, there will be described the sub tank 4. FIG. 2 is a general perspective view of the sub tank 4 shown in FIG. 1. FIG. 3 is a plan view of the sub tank 4 shown in FIG. 2. FIGS. 4A-4D are cross-sectional views taken along lines 4A-4A, 4B-4B, 4C-4C and 4D-4D in FIG. 3, respectively. FIG. 5 is a cross-sectional view taken along line 5-5 in FIG. 3. FIG. 6 shows in enlargement a part enclosed by a broken line in each of FIGS. 4A-4D. For facilitating comprehension, in FIG. 3, inlet tubes 31*a*-31*d* of a connecting unit 21 (described later) and an air discharge device 23 (described later) are indicated by chain double-dashed line, and a connecting portion 32 of a connecting unit 21 (described later) and a part of a mainbody 22 of the sub tank 4 are not shown. Since the part enclosed by the broken line is identical among all of FIGS. 4A-4D, only one drawing, namely, FIG. 6 is provided to illustrate the part. That is, in FIG. 6, reference numerals without brackets denote members or elements in FIG. 4A, and reference numerals with brackets denote members or elements in FIGS. 4B-4D.

As shown in FIGS. 2-6, the sub tank 4 includes the connecting unit 21, the mainbody 22, and the air discharge device 23.

The connecting unit 21 connects the ink tubes 5*a*-5*d* with the sub tank 4, and has the inlet tubes 31*a*-31*d* and the connecting portion 32. The inlet tubes 31*a*-31*d* are cylindrical tubes extending parallel to each other and along the main scanning direction, and arranged in the sheet feeding direction at regular intervals. The inlet tubes 31*a*-31*d* are connected with the ink tubes 5*a*-5*d*, respectively, at their ends at the right side as seen in FIG. 2 (although in FIGS. 2 and 3 the ink tubes 5*a*-5*d* are not shown), and connected with the connecting portion 32 at their ends at the left side as seen in FIG. 2. The connecting portion 32 is bonded to an upper surface of an end portion with respect to the main scanning direction of the mainbody 22 of the sub tank 4, and establishes communication between the inlet tubes 31*a*-31*d* and connection openings 41*a*-41*d* (described later) of the mainbody 22 of the sub tank 4.

The mainbody 22 of the sub tank 4 has the connection openings 41*a*-41*d*, ink passages 42*a*-42*d*, 43*a*-43*d*, 46*a*-46*d*, 47*a*-47*d*, ink storage chambers 44*a*-44*d*, damper films 45*a*-45*d*, an air chamber 49, and an air-permeable film 60. The connection openings 41*a*-41*d*, each circular in plan view, are arranged vertically at a lower right portion as seen in FIG. 3 of the mainbody 22 of the sub tank 4. Into the mainbody 22 of the sub tank 4, the inks are supplied through the connection openings 41*a*-41*d*.

As seen in FIG. 3, the ink passage 42*a* extends from the connection opening 41*a* upward and then turns obliquely rightward, to a position under and adjacent to the ink storage chambers 44*a*-44*d*.

As seen in FIG. 3, the ink passage 42*b* extends from the connection opening 41*b* leftward and then turns upward and thereafter rightward, to a position under and adjacent to the ink storage chambers 44*a*-44*d*.

As seen in FIG. 3, the ink passage 42*c* extends from the connection opening 41*c* leftward and then turns upward and thereafter leftward, to a position under and adjacent to the ink storage chambers 44*a*-44*d*.

As seen in FIG. 3, the ink passage 42*d* extends from the connection opening 41*d* leftward and then turns upward and thereafter leftward, to a position under and adjacent to the ink storage chambers 44*a*-44*d*.

As seen in FIG. 3, the vertically extending portions of the ink passages 42*a*-42*d* are arranged from right to left in the alphabetical order.

The ink storage chambers 44*a*-44*d* are disposed at the positions adjacent to and over upper ends of the ink passages 42*a*-42*d* as seen in FIG. 3, such that the ink storage chambers 44*a*-44*d* overlap with one another in plan view. As shown in FIGS. 4A-4D, the ink storage chambers are vertically arranged in the following order from top down: 44*b*, 44*a*, 44*d*, 44*c*. In plan view, each of the ink storage chambers 44*a*-44*d* has a rectangular shape long in a left-right direction of FIG. 3.

On an upper end of the ink storage chamber 44*b* and a lower end of the ink storage chamber 44*a*, the damper films 45*b*, 45*a* are respectively disposed. That is, the damper films 45*b*, 45*a* respectively define the upper surface of the ink storage chamber 44*b* and the under surface of the ink storage chamber 44*a*. Between the ink storage chambers 44*b* and 44*a*, a separating wall 50 is disposed. That is, the separating wall 50 separates the ink storage chambers 44*b* and 44*a* from each other.

On an upper end of the ink storage chamber 44*d* and a lower end of the ink storage chamber 44*c*, the damper films 45*d*, 45*c* are respectively disposed. That is, the damper films 45*d*, 45*c* respectively define the upper surface of the ink storage chamber 44*d* and the under surface of the ink storage chamber 44*c*. Between the ink storage chambers 44*d* and 44*c*, a separating wall 51 is disposed. That is, the separating wall 51 separates the ink storage chambers 44*d* and 44*c* from each other. Between the ink storage chambers 44*a* and 44*d*, that is, between the damper films 45*a* and 45*d*, a space is defined.

When the sub tank 4 is reciprocated with the carriage 2 in the main scanning direction while recording is performed or in other situations, the inks in the sub tank 4 move or oscillate to change the ink pressures in the sub tank 4, but the damper films 45*a*-45*d* deform and function to restrict such a pressure change.

The ink passage 43*a* extends vertically downward as seen in FIGS. 4A-4D from the upper end as seen in FIG. 3 of the ink passage 42*a* to the same vertical level as the ink storage chamber 44*a*, and then turns leftward as seen in FIG. 4A to be connected with the ink storage chamber 44*a*.

The ink passage 43*b* extends from the upper end as seen in FIG. 3 of the ink passage 42*b* in the same direction as the ink passage 42*b* (i.e., leftward as seen in FIG. 4B) to be connected with the ink storage chamber 44*b*.

The ink passage 43*c* extends vertically downward as seen in FIG. 4C from the upper end as seen in FIG. 3 of the ink passage 42*c* to the same vertical level as the ink storage chamber 44*c*, and then turns leftward as seen in FIG. 4C to be connected with the ink storage chamber 44*c*.

The ink passage 43*d* extends vertically downward as seen in FIG. 4D from the upper end as seen in FIG. 3 of the ink passage 42*d* to the same vertical level as the ink storage chamber 44*d*, and then turns leftward as seen in FIG. 4D to be connected with the ink storage chamber 44*d*.

As seen in FIGS. 4A-4D, the ink passages 46*a*-46*d* respectively extend leftward from left ends of the ink storage chambers 44*a*-44*d* to be connected with the ink passages 47*a*-47*d* that extend vertically and are arranged in the alphabetical order from left to right as seen in FIG. 3 and adjacent to one another.

The ink passages 47*a*-47*d* open at their lower ends. That is, the lower ends provides ink supply portions 48*a*-48*d* respectively connected with ink supply ports 89 (shown in FIG. 8) formed on the upper surface of the inkjet head 3. The inks in the ink passages 47*a*-47*d* are supplied to the inkjet head 3 through the ink supply portions 48*a*-48*d*.

In the printer 1, the inks in the ink cartridges 6*a*-6*d* flow into the inlet tubes 31*a*-31*d* via the ink tubes 5*a*-5*d*, and then into the ink storage chambers 44*a*-44*d* through the connection openings 41*a*-41*d* and the ink passages 42*a*-42*b*, 43*a*-43*d*. Further, the inks temporarily stored in the ink storage chambers 44*a*-44*d* flow into the ink passages 47*a*-47*d* through the ink passages 46*a*-46*d*, and are supplied to the inkjet head 3 through the ink supply portions 48*a*-48*d*.

Each of the ink passage extending from one of the ink cartridges 6*a*-6*d* to the inkjet head 3 via the corresponding ink tube 5*a*-5*d*, inlet tube 31*a*-31*d*, connection opening 41*a*-41*d*, ink passages 42*a*-42*d*, 43*a*-43*d*, the ink storage chamber 44*a*-44*d*, and ink passages 46*a*-46*d*, 47*a*-47*d* corresponds to a liquid supply passage.

As seen in a left-right direction in FIGS. 4A-4D, the air chamber 49 is disposed at a position to overlap the ink passages 47*a*-47*d* and extends across the ink passages 47*a*-47*d*. The air-permeable film 60 is disposed at an area corresponding to a boundary between the ink passages 47*a*-47*d* and the air chamber 49 and including vicinities of the boundary on the two opposite sides, namely, a portion of the ink passages 47*a*-47*d* and a portion of the air chamber 49 which portions are adjacent to the boundary. This area corresponds to one of two different places at each of which the liquid supply passage and the gas discharge passage are connected with each other. The air-permeable film 60 extends vertically, and functions as a wall that separates each of the ink passages 47*a*-47*d* from the air chamber 49.

The air-permeable film 60 allows only gases to pass therethrough, and does not allow liquids to pass therethrough. Hence, a gas or air contained in the ink passages 47*a*-47*d* is discharged through the air-permeable film 60 to the air chamber 49. Since the ink passages 47*a*-47*d* and the air-permeable film 60 extend vertically, the ink level in each of the ink passages 47*a*-47*d* lowers as an amount of the gas or air flowing into the ink passage 47*a*-47*d* increases. That is, a contact surface between the gas or air in the ink passage 47*a*-47*d* and the air-permeable film 60 increases with the amount of the gas or air that flows into the ink passage 47*a*-47*d*. Therefore, even when a large amount of the gas or air flows into the ink passage 47*a*-47*d*, the gas or air can be discharged through the air-permeable film 60 to the air chamber 49 with high efficiency.

On a left side as seen in FIGS. 4A-4D of the air-permeable film 60, that is, on a surface of the air-permeable film 60 on the side of the air chamber 49, a piece of an unwoven fabric or material 55 is disposed at a position to overlap each of the ink passages 47*a*-47*d* as seen in the left-right direction in FIGS. 4A-4D. On a left surface as seen in FIGS. 4A-4D of each piece of the unwoven material 55 (i.e., the surface thereof on the side opposite to the air-permeable film 60), electrodes 56 and 57 are disposed at an upper end and a lower end of the surface, respectively.

As described above, the air-permeable film 60 allows the air to pass therethrough but does not allow the liquids including the inks to pass therethrough. However, after a long-term use of the printer 1, the air-permeable film 60 may be clogged with the ink(s), and ultimately the ink(s) may leak from the ink passage(s) 47*a*-47*d* through the air-permeable film 60 into the air chamber 49.

Where leakage of an ink through the air-permeable film 60 occurs, the ink leaking into the air chamber 49 is absorbed by the corresponding piece of the unwoven material 55 and spreads over an entirety thereof, and the electrodes 56 and 57 disposed on the piece of unwoven material 55 are electrically conducted with each other via the ink spreading over the entire piece of the unwoven material 55. Therefore, by detecting electrical conduction established between the electrodes 56 and 57, it is detectable that an ink leakage through the air-permeable film 60 occurs. It is noted that the piece of the unwoven material 55, the electrodes 56, 57, and an ink-leakage detecting portion 133 (described later) of the controller 100 cooperate to constitute a liquid-leakage detector.

The air discharge device 23 constitutes a part of the gas discharge passage through which the gas or air is discharged from the mainbody 22 of the sub tank 4. The air discharge device 23 has a connecting portion 61 and a discharge tube 62. The connecting portion 61 is disposed on the upper surface of the mainbody 22 of the sub tank 4, at a position to overlap the ink passages 47*a*-47*d* and the air chamber 49 in plan view, and extends across the ink passages 47*a*-47*d* and the air chamber 49 to cover the ink passages 47*a*-47*d* and the air chamber 49. In the connecting portion 61, a communication passage 63, individual air chambers 64*a*-64*d*, and a common air chamber 65 are formed, and a partition wall 59 and separating walls 66 are disposed. The communication passage 63, individual air chambers 64*a*-64*d*, and common air chamber 65 constitute a part of the gas discharge passage.

The communication passage 63 is disposed at a position to overlap or positionally correspond to the air chamber 49 in plan view. The individual air chambers 64*a*-64*d* are disposed on the right side as seen in FIGS. 4A-4D of the communication passage 63 at a position to respectively overlap the ink passages 47*a*-47*d* in plan view. Between the individual air chambers 64*a* and 64*b*, between the individual air chambers 64*b* and 64*c*, and between the individual air chambers 64*c* and 64*d*, a separating wall 66 is disposed. That is, there are disposed three separating walls 66 to separate the individual air chambers 64*a*-64*d* from one another.

The partition wall 59 is disposed between the communication passage 63 and the individual air chambers 64*a*-64*d*, that is, the partition wall 59 is disposed in a portion in the gas discharge passage between the air-permeable film 60 and a shut-off valve 69. The partition wall 59 extends upward from a bottom surface of a connecting portion where the communication passage 63 is connected with the individual air chambers 64*a*-64*d*. The communication passage 63 is communicated with the individual air chambers 64*a*-64*d* only above or over the partition wall 59. The partition wall 59 functions to inhibit the inks in the individual air chambers 64*a*-64*d* from flowing into the air chamber 49 via the communication passage 63, and corresponds to a liquid-inflow inhibiting wall.

In addition, a through-hole 58*a*-58*d* substantially circular in plan view is formed between each individual air chamber 64*a*-64*d* and a corresponding one of the ink passages 47*a*-47*d*. That is, the through-hole 58*a*-58*d* vertically extends between a bottom surface of the individual air chamber 64*a*-64*d* and an upper surface of the ink passage 47*a*-47*d*, and the individual air chamber 64*a*-64*d* and the ink passage 47*a*-47*d* are communicated with each other via the through-hole 58*a*-58*d*.

At an area across an upper end of the ink passage 47*a*-47*d*, the through-hole 58*a*-58*d*, and a lower end of the individual air chamber 64*a*-64*d* (which area corresponds to the other of the two different places at each of which the liquid supply passage and the gas discharge passage are connected with each other), a shut-off valve 69 is disposed.

The shut-off valve 69 has a columnar portion 69*a*, a shut-off portion 69*b*, and a pressing portion 69*c*. The columnar portion 69*a* has a substantially columnar shape whose diameter is slightly smaller than that of the through-hole 58*a*-58*d*, and extends from an upper end portion of the ink passage 47*a*-47*d* to a lower end portion of the individual air chamber 64*a*-64*d* through the through-hole 58*a*-58*d*. The shut-off portion 69*b* is disposed at an upper end of the columnar portion 69*a* and extends radially outward of the columnar portion 69*a* in a beveled shape having a diameter larger than that of the through-hole 58*a*-58*d*.

The pressing portion 69*c* is disposed at a lower end of the columnar portion 69*a* and extends radially outward of the columnar portion 69*a*. Between the upper surface of the ink passage 47*a*-47*d* and an upper surface of the pressing portion 69*c*, a spring 70 is disposed. As seen in FIGS. 4A-4D, the pressing portion 69*c* is held pressed downward by the spring 70, whereby the shut-off valve 69 is held pressed downward.

The common air chamber 65 is disposed on the right side as seen in FIGS. 4A-4D of the individual air chambers 64*a*-64*d*, at a position to overlap the individual air chambers 64*a*-64*d* as seen in the left-right direction of FIGS. 4A-4D, and extends across the individual air chambers 64*a*-64*d*. The common air chamber 65 is in communication with the individual air chambers 64*a*-64*d*.

By disposing the air chamber 49, the air-permeable film 60, the communication passage 63, the individual air chambers 64*a*-64*d*, the through-holes 58*a*-58*d*, and the shut-off valves 69 as described above, a plane along which the air-permeable film 60 is disposed or extends is differentiated from a plane in which the shut-off valves 69 are disposed. Hence, as compared to a case where the air-permeable film 60 is disposed or extends along a plane in which the shut-off valves 69 are disposed, a dimension of the sub tank 4 in the left-right direction as seen in FIGS. 4A-4D can be reduced.

In the sub tank 4, each of the ink passages 47*a*-47*d* is connected with the air chamber 49 via the air-permeable film 60, as well as connected with the corresponding individual air chamber 64*a*-64*d* via the through-hole 58*a*-58*d*. That is, the liquid supply passage and the gas discharge passage are connected with each other in the sub tank 4 at two different places, at one of which the air-permeable film 60 is disposed and at the other of which the shut-off valves 69 are disposed.

The sub tank 4 constituting a part of the liquid supply passage is larger in dimensions than the tubes 5*a*-5*d* constituting another part of the liquid supply passage. Hence, by connecting the liquid supply passage and the gas discharge passage with each other at the two different places in the sub tank 4 where the air-permeable film 60 and the shut-off valves 69 are respectively disposed, dimensions of the air-permeable film 60 and the shut-off valve 69 can be increased as compared to a case where the air-permeable film and the shut-off valves are disposed in the tubes 5*a*-5*d* or other portions in the liquid supply passage than in the sub tank 4. Thus, the inks whose viscosities have increased, and the air, which are inside the ink passages 47*a*-47*d*, can be discharged to the gas discharge passage with high efficiency.

The discharge tube 62 is a cylindrical tube whose one end is connected with a substantially central portion of a lower side (as seen in FIG. 3) of the common air chamber 65. In FIG. 3, the discharge tube 62 extends downward from the portion where the discharge tube 62 is connected with the common air chamber 65 and then turns leftward to form a horizontally extending portion. The horizontally extending portion of the discharge tube 62 and the inlet tubes 31*a*-31*d* are arranged in the sheet feeding direction at regular intervals. An end of the horizontally extending portion of the discharge tube 62 is connected with the air tube 7*a*, although in FIGS. 2 and 3 the air tube 7*a* is not shown.

Figure 7A:
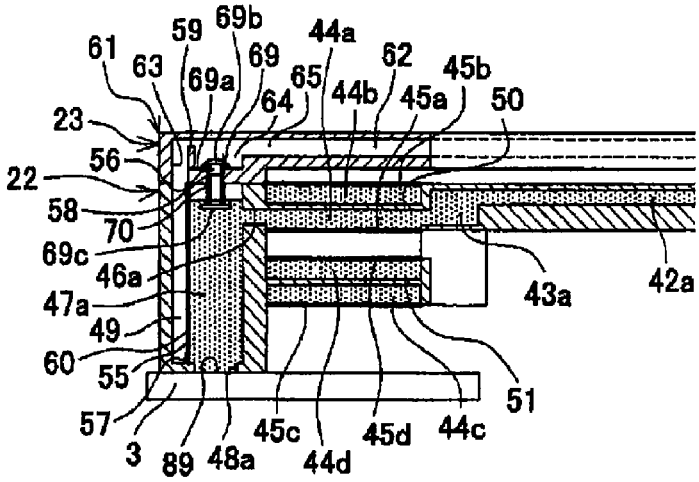
FIGS. 7A and 7B illustrate an operation of a shut-off valve disposed in the sub tank.
Figure 7B:
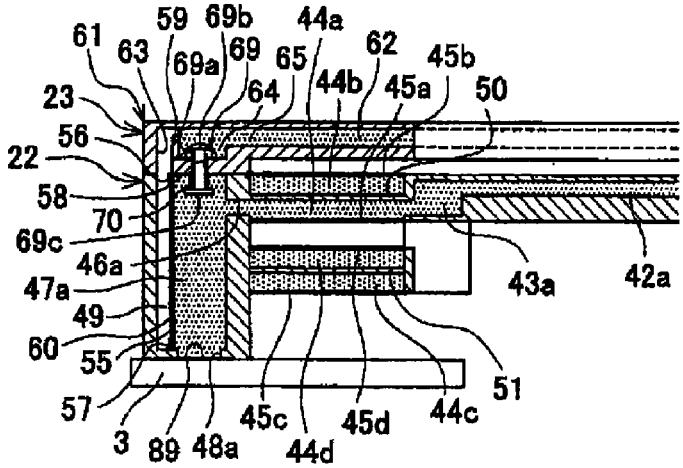

There will be described an operation of the shut-off valve 69. FIGS. 7A and 7B illustrate how each of the shut-off valves 69 shown in FIGS. 4A-4D operates. FIG. 7A shows a state where the shut-off valve 69 is in a closing position, and FIG. 7B shows a state where the shut-off valve 69 is in an opening position. Since all the shut-off valves 69 corresponding to the respective ink passages 47*a*-47*d* operate in the same way, only one of the four shut-off valves 69 that corresponds to the ink passage 47*a* is shown in FIGS. 7A and 7B. The shut-off valve 69 is selectively placed in one of the closing and opening positions depending on the internal pressure of the individual air chamber 64*a*-64*d* (or that of the gas discharge passage), as described later.

When the suction pump 14 sucks the air from the gas discharge passage, the air in the air chamber 49, the communication passage 63, the individual air chambers 64*a*-64*d*, and the common air chamber 65, which constitute a part of the gas discharge passage, is sucked through the discharge tube 62, and the internal pressure of the air chamber 49, the communication passage 63, the individual air chambers 64*a*-64*d*, and the common air chamber 65 decreases. As a result, an upward force as seen in FIGS. 7A and 7B deriving from a difference between the internal pressure of the individual air chamber 64*a*-64*d* and that of the ink passage 47*a*-47*d* acts on the shut-off valve 69.

While the internal pressure of the individual air chamber 64*a*-64*d* is equal to or higher than a threshold, the force deriving from the difference between the internal pressures of the individual air chamber 64*a*-64*d* and the ink passage 47*a*-47*d* and acting on the shut-off valve 69 is equal to or smaller than a force with which the spring 70 presses the shut-off valve 69. In this case, the shut-off valve 69 is held pressed downward as seen in FIGS. 4A-4D by the spring 70, with the shut-off portion 69*b* of the shut-off valve 69 held in pressing contact with the bottom surface of the individual air chamber 64*a*-64*d*, that is, a clearance is not formed between the shut-off portion 69*b* and the bottom surface of the individual air chamber 64*a*-64*d*, as shown in FIG. 7A. In this state, the ink passage 47*a*-47*d* and the corresponding individual air chamber 64*a*-64*d* are not communicated with each other, and the ink in the ink passage 47*a*-47*d* does not flow out into the individual air chamber 64*a*-64*d*. In other words, the shut-off valve 69 is in a shut-off state. In this case, the air in the ink passage 47*a*-47*d* is discharged to the air chamber 49 through the air-permeable film 60.

On the other hand, while the internal pressure of the individual air chamber 64*a*-64*d* is lower than the threshold, the force deriving from the difference between the internal pressures of the individual air chamber 64*a*-64*d* and the ink passage 47*a*-47*d* and acting on the shut-off valve 69 is greater than the force with which the spring 70 presses the shut-off valve 69. In this case, the shut-off valve 69 is displaced upward as seen in FIGS. 4A-4D against the pressing force from the spring 70, as shown in FIG. 7B. Thus, a clearance is formed between the shut-off portion 69*b* and the bottom surface of the individual air chamber 64*a*-64*d*, and the ink passage 47*a*-47*d* and the individual air chamber 64*a*-64*d* are communicated with each other via the through-hole 58*a*-58*d*. That is, the shut-off valve 69 is in an open state.

Hence, the ink with a relatively high viscosity in the ink passage 47*a*-47*d* is discharged to the individual air chamber 64*a*-64*d* or the gas discharge passage via the through-hole 58*a*-58*d* by a suction force from the suction pump 14, and then discharged to the external from the gas discharge passage. In this case, the air in the ink passage 47*a*-47*d* is discharged to the air chamber 49 through the air-permeable film 60, as well as discharged along with the ink to the individual air chamber 64*a*-64*d* via the through-hole 58*a*-58*d*.

In the liquid supply passage, the sub tank 4 has an inner volume larger than that of the other portions of the liquid supply passage. Hence, the sub tank 4 contains larger volumes of the air and the inks whose viscosities have increased, than the other portions do. Further, the viscosities of the inks in the tubes 5*a*-5*d* that are formed of a synthetic resin or others and constitute an upstream portion of the liquid supply passage with respect to the sub tank 4 tend to increase due to evaporation of water and others from the inks through walls of the tubes 5*a*-5*d*. The inks whose viscosities have increased in the tubes 5*a*-5*d* in this way then flow into the sub tank 4. Hence, the amounts of the inks with the increased viscosities contained in the sub tank 4 further increase.

Therefore, the two different places at each of which the liquid supply passage and the gas discharge passage are connected with each other are disposed in the sub tank 4, and the air-permeable film 60 is disposed at one of the two different places and the shut-off valves 69 are disposed at the other of the two different places, as described above, so as to enable to efficiently discharge the air and the inks with the increased viscosities from the liquid supply passage.

Since the air-permeable film 60 and the shut-off valves 69 can be made relatively large in dimensions, as described above, the air and the inks whose viscosities have increased that are in the liquid supply passage can be further efficiently discharged to the gas discharge passage.

In addition, in the gas discharge passage the individual air chambers 64*a*-64*d* (or the shut-off valves 69) are disposed on the side of the discharge tube 62 (or the suction pump 14) with respect to the air chamber 49 (or the air-permeable film 60). Hence, when the suction pump 14 sucks the inks in the ink passages 47*a*-47*d* through the gas discharge passage and consequently the inks flow into the individual air chambers 64*a*-64*d*, the inks tend to flow to the common air chamber 65 (or to the side of the suction pump 14) but do not tend to flow to the communication passage 63 (or to the side of the air-permeable film 60). Thus, the left surface as seen in FIGS. 4A-4D of the air-permeable film 60 does not tend to be contaminated with the inks. Since the partition wall 59 is disposed between the communication passage 63 and the individual air chambers 64*a*-64*d*, a possibility that the inks in the individual air chambers 64*a*-64*d* flow into the communication passage 63 is further decreased. Since the air-permeable film 60 extends vertically, even when the inks in the individual air chambers 64*a*-64*d* flow into the air chamber 49 via the communication passage 63, the inks flowing into the air chamber 49 drop or fall to a bottom of the air chamber 49 and do not tend to adhere to and contaminate the left surface of the air-permeable film 60 or the pieces of the unwoven material 55. It is noted that even when the ink flowing into the air chamber 49 adheres to and is absorbed by the piece of the unwoven material 55, an amount of the ink thus adhering to the piece of the unwoven material 55 is so small that a possibility that the electrodes 56, 57 are electrically conducted with each other via the ink absorbed by the piece of the unwoven material 55 and it is erroneously detected that an ink leakage occurs at the air-permeable film 60 is negligible.

Since the inks with the increased viscosities are discharged from the ink passages 47*a*-47*d* without passing through the nozzles 95, as described above, the printer 1 is free from clogging of the nozzles 95 with the inks with the increased viscosities.

Figure 8:
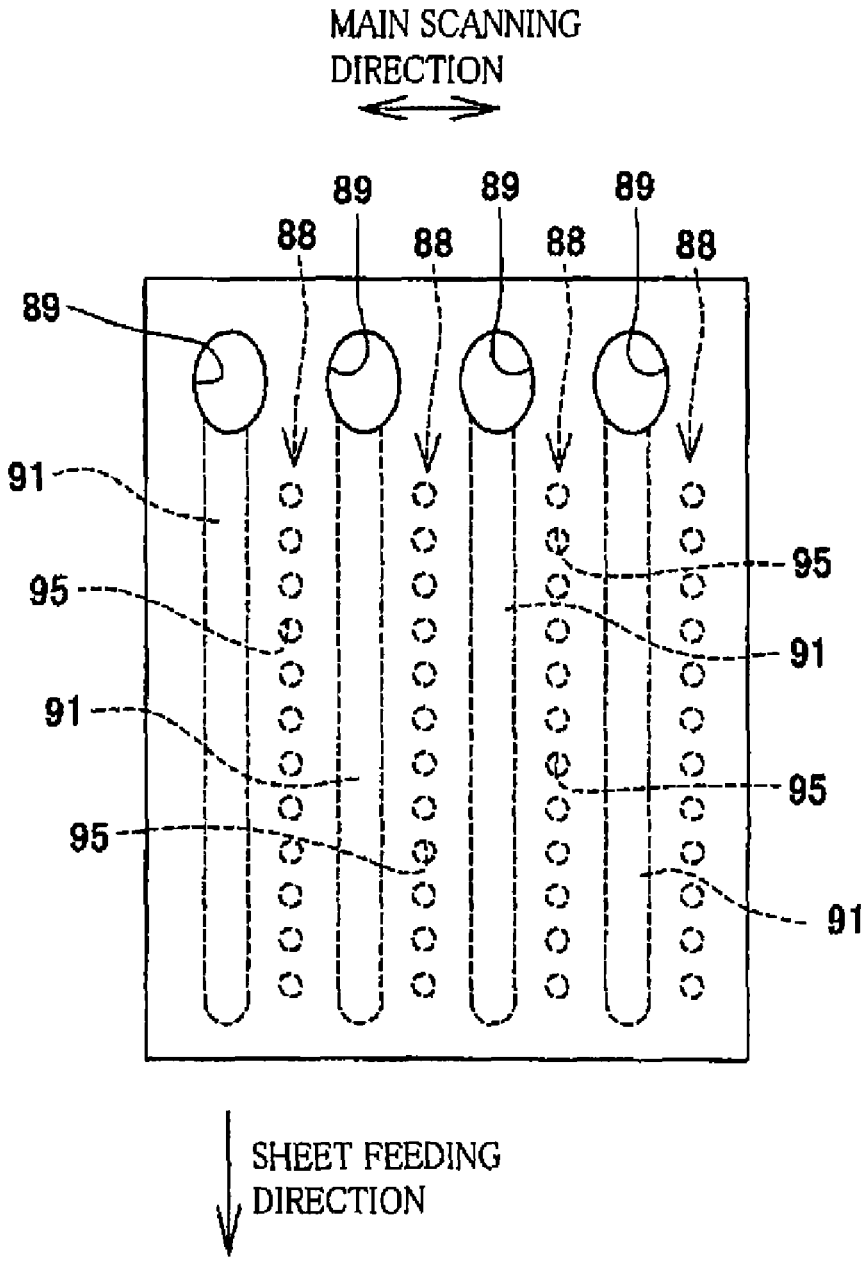
FIG. 8 is a plan view of an inkjet head shown in FIG. 1.
Figure 9:
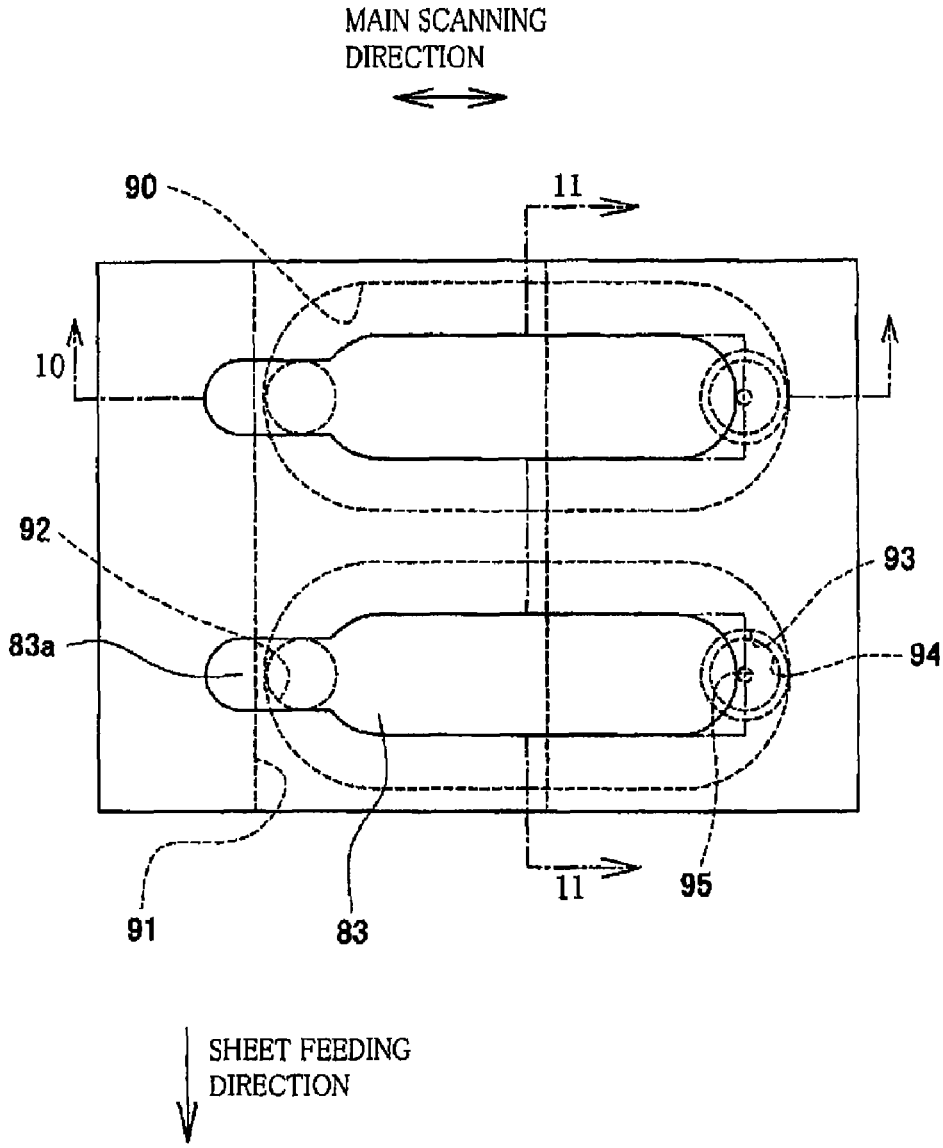
FIG. 9 shows in enlargement a part of FIG. 8.
Figure 10:
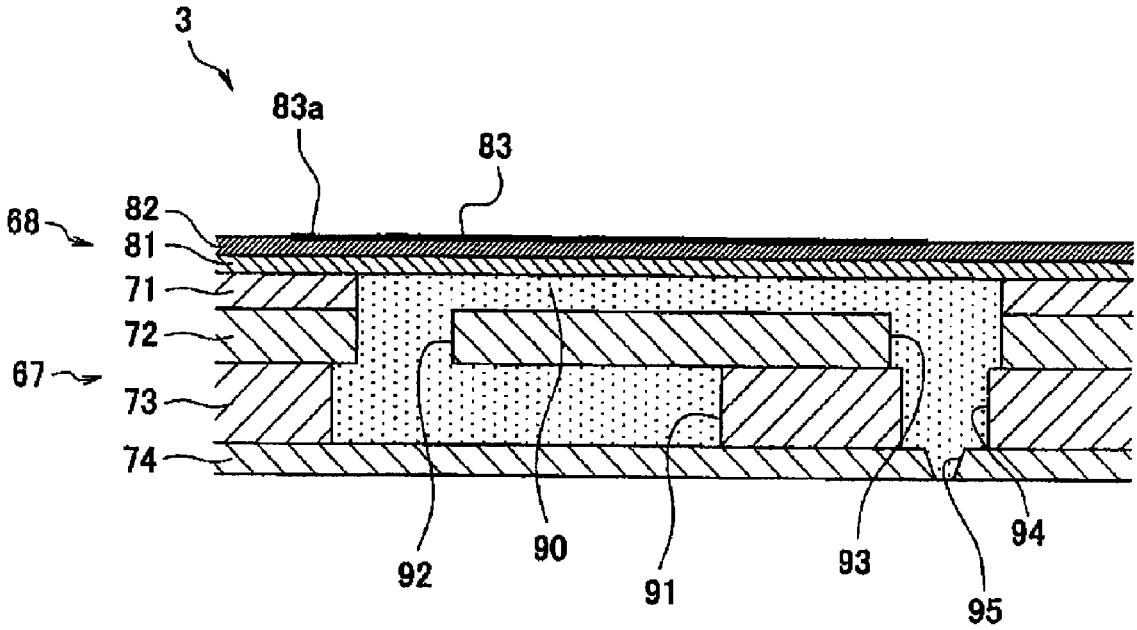
FIG. 10 is a cross-sectional view taken along line 10-10 in FIG. 9.
Figure 11:
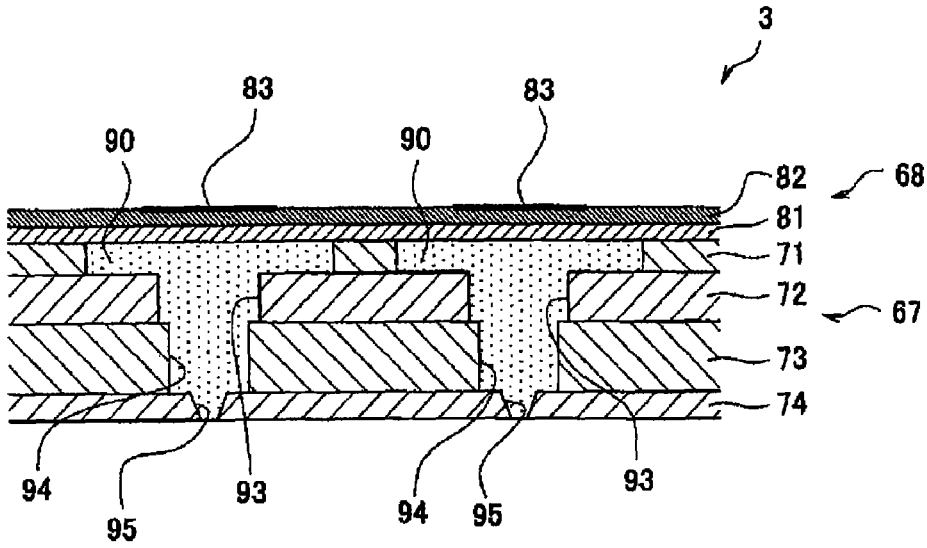
FIG. 11 is a cross-sectional view taken along line 11-11 in FIG. 9.

Referring to FIGS. 8-11, there will be described the inkjet head 3. FIG. 8 is a plan view of the inkjet head 3 shown in FIG. 1. FIG. 9 shows a part of FIG. 8 in enlargement. FIGS. 10 and 11 are cross-sectional views respectively taken along lines 10-10 and 11-11 in FIG. 9. For facilitating comprehension, in FIG. 8, pressure chambers 90 and through-holes 92-94 that will be described later are not shown, and the nozzles 95 are depicted as being large as compared to those in FIGS. 9-11.

As shown in FIGS. 8-11, the inkjet head 3 includes a passage unit 67 in which ink passages each including a pressure chamber 90 are formed, and a piezoelectric actuator 68 disposed on an upper surface of the passage unit 67.

The passage unit 67 is a laminate of four plates, namely, a cavity plate 71, a base plate 72, a manifold plate 73, and a nozzle plate 74 that are stacked in the order of description from top down. Among the four plates 71-74, the base, manifold, and nozzle plates 71-73 are formed of a metallic material such as stainless steel, and the nozzle plate 74 is formed of a synthetic resin material such as polyimide. Alternatively, the nozzle plate 74 may be formed of a metallic material like the other plates 71-73.

In the nozzle plate 74, a plurality of nozzles 95 are formed. The nozzles 95 are arranged in four rows 88 which are arranged in the main scanning direction (i.e., the left-right direction as seen in FIG. 8) and each of which extends in the sheet feeding direction (i.e., the vertical direction as seen in FIG. 8). From the nozzles 95 of the respective rows 88, droplets of the black, yellow, cyan, and magenta inks are ejected, from left to right as seen in FIG. 8.

In the cavity plate 71, a plurality of pressure chambers are formed to respectively correspond to the nozzles 95. In plan view, each of the pressure chambers 90 has an elliptic shape long in the main scanning direction, and the pressure chambers 90 are disposed such that right ends thereof overlap the nozzles 95 in plan view. In the base plate 72, the through-holes 92, 93 are formed at respective positions that overlap opposite longitudinal ends of the pressure chambers 90 in plan view.

In the manifold plate 73 are formed four manifold passages 91 corresponding to the four nozzle rows 88. The manifold passages 91 extend in the sheet feeding direction on the left side of the corresponding nozzle rows 88, respectively. Each of the manifold passages 91 overlaps a substantially left half of the pressure chambers 90 of the corresponding row in plan view. At an upper end portion of each of the manifold passages 91 as seen in FIG. 8, one of the ink supply ports 89 is disposed. The ink supply ports 89 are connected with the ink supply portions 48*a*-48*d* of the sub tank 4 as described above, and the inks in the sub tank 4 are supplied through the ink supply ports 89 to the manifold passages 91. In the manifold plate 73, through-holes 94 are formed at positions to overlap the through-holes 93 and the nozzles 95 in plan view.

In the passage unit 67, the manifold passages 91 are communicated with the pressure chambers 90 via the through-holes 92, and the pressure chambers 90 are further communicated with the nozzles 95 via the through-holes 93, 94. In this way, in the passage unit 67 are formed a plurality of individual ink passages each extending from an outlet of one of the manifold passages 91 to one of the nozzles 95 via one of the pressure chambers 90.

The piezoelectric actuator 68 includes a diaphragm 81, the piezoelectric layer 82, and a plurality of individual electrodes 83. The diaphragm 81 is formed of an electrically conductive material such as metal material, and bonded to an upper surface of the cavity plate 71 to cover the pressure chambers 90. The diaphragm 81, which has an electrical conductivity, also functions as a common electrode for applying voltage to portions of the piezoelectric layer 82 disposed between the respective individual electrodes 83 and the diaphragm 81, as described later, and is connected with a driver IC (not shown) to be kept at the ground voltage.

The piezoelectric layer 82 is formed of a piezoelectric material containing mixed crystals of lead titanate and lead zirconate and has a ferroelectricity, that is, the primary component of the piezoelectric material is lead zirconate titanate. The piezoelectric layer 82 is disposed on an upper surface of the diaphragm 81 continuously across the pressure chambers 90. The piezoelectric layer 82 is polarized in a direction of its thickness.

The individual electrodes 83 are disposed on an upper surface of the piezoelectric layer 82 to positionally correspond to the pressure chambers 90. In plan view, each of the individual electrodes 83 has a substantially elliptic shape smaller than that of the pressure chamber 90, and disposed at a position corresponding to a substantially central portion of the corresponding pressure chamber 90. A longitudinal end of the individual electrode 83, i.e., a left end thereof as seen in FIG. 9, is located on the left side of the pressure chamber 90 and does not overlap the pressure chamber 90 in plan view. This end provides a contact 83*a*, with which the driver IC (not shown) is connected through a wiring member (not shown) such as a flexible printed circuit board (FPC). By operation of the driver IC, a drive voltage is selectively applied to the individual electrodes 83.

There will be described how the piezoelectric actuator 68 is driven. In the piezoelectric actuator 68, the electrical potential of the individual electrodes 83 is kept at the ground voltage by the driver IC not shown. When the driver IC applies a drive voltage to one of the individual electrodes 83, a potential difference occurs between the individual electrode 83 to which the drive voltage is applied and the diaphragm 81 as a common electrode kept at the ground voltage. Thus, an electrical field occurs, in the direction of the thickness of the piezoelectric layer 82, at a portion of the piezoelectric layer 82 that is sandwiched between the individual electrode 83 and the diaphragm 81. Since the direction of the electrical field is parallel to the direction in which the piezoelectric layer 82 is polarized, the portion of the piezoelectric layer 82 contracts in a horizontal direction which is perpendicular to the polarization direction. Thus, a portion of the diaphragm 81 and the piezoelectric layer 82 that is opposed to the pressure chamber 90 corresponding to the individual electrode 83 to which the drive voltage is applied deforms convexly toward the pressure chamber 90, whereby an inner volume of the pressure chamber 90 is reduced. Hence, the ink pressure in the pressure chamber 90 increases, thereby ejecting an ink droplet from the nozzle 95 in communication with the pressure chamber 90.

There will be described the differential pressure valve 9, by referring to FIG. 12 which is a cross-sectional view of the differential pressure valve 9 shown in FIG. 1.

Figure 12:
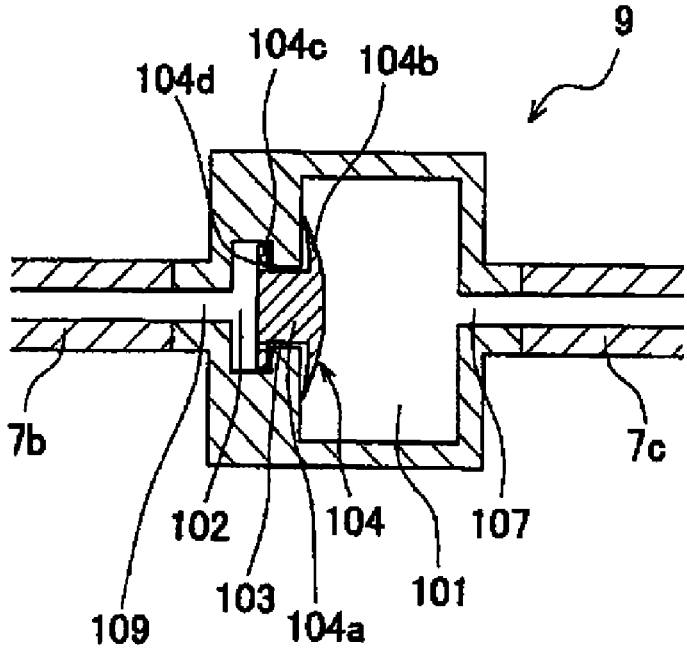
FIG. 12 is a cross-sectional view of a differential pressure valve shown in FIG. 1.

As shown in FIG. 12, the differential pressure valve 9 includes air chambers 101, 102, a communication passage 103, and a valve element 104. The air chambers 101 and 102 are disposed side by side in a left-right direction as seen in FIG. 12. The air chamber 101 has a communication port 107 at a right end thereof as seen in FIG. 12, and is connected with the tube 7*c* at the communication port 107. The air chamber 102 has a communication port 109 at a left end thereof as seen in FIG. 12, and is connected with the tube 7*b* at the communication port 109. The communication passage 103 extends between the air chambers 101 and 102 in the left-right direction in FIG. 12 to establish communication therebetween. The communication passage 103 is generally circular when seen in the left-right direction in FIG. 12, and has a diameter smaller than dimensions of the air chambers 101, 102 in the vertical direction in FIG. 12 and in a direction perpendicular to the plane of the sheet in which FIG. 12 is presented.

The valve element 104 includes a columnar portion 104*a*, a cutoff portion 104*b*, and a retaining portion 104*c*. The columnar portion 104*a* has a substantially columnar shape whose diameter is slightly smaller than that of the communication passage 103, and extends from a left end portion of the air chamber 101 to a right end portion of the air chamber 102 as seen in FIG. 12 through the communication passage 103. The cutoff portion 104*b* is disposed adjacent to a right end of the columnar portion 104*a* as seen in FIG. 12, and extends from the columnar portion 104*a* radially outward of the columnar portion 104*a* in a beveled shape whose diameter is larger than that of the communication passage 103. The retaining portion 104*c* is disposed adjacent to a left end of the columnar portion 104*a* as seen in FIG. 12, and extends from the columnar portion 104*a* radially outward of the columnar portion 104*a*. A diameter of the retaining portion 104*c* is larger than that of the communication passage 103. In a portion of the retaining portion 104*c* which overlaps with respect to the left-right direction in FIG. 12 a peripheral portion of the communication passage 103, a plurality of through-holes 104*d* are formed. The air chambers 101 and 102, the communication passage 103, and the valve element 104 of the differential pressure valve 9 cooperate to constitute a differential pressure valve.

While the suction pump 14 is operating to suck the air from the gas discharge passage, the valve element 104 moves rightward as seen in FIG. 12 by receiving the negative suction pressure from the suction pump 14. Thus, a clearance occurs between the cutoff portion 104*b* and a left wall of the air chamber 101 as seen in FIG. 12, that is, the differential pressure valve opens. Consequently, the air chambers 101 and 102 are communicated with each other via the through-holes 104*d* and the communication passage 103. When the communication between the air chambers 101, 102 is thus established, the gas discharge passage and the suction pump 14 are communicated with each other. Since at this time a right surface of the retaining portion 104*c* is brought into contact with a surface of a right wall partially defining the air chamber 102, the valve element 104 is prevented from falling out of the communication passage 103. When the suction pump 14 sucks the air from the gas discharge passage with the communication between the gas discharge passage and the suction pump 14 being established, the air in the gas discharge passage is discharged as well as the air in the ink passages 47*a*-47*d* is discharged to the air chamber 49 (or the gas discharge passage) through the air-permeable film 60, and the internal pressure of the gas discharge passage decreases to a level lower than the atmospheric pressure.

As described above, when the internal pressure of the gas discharge passage is equal to or higher than the threshold, the force deriving from the difference between the internal pressures of the individual air chamber 64*a*-64*d* and the ink passage 47*a*-47*d* and acting on the shut-off valve 69 is equal to or smaller than the force with which the spring 70 presses the shut-off valve 69, and the shut-off valve 69 is held in the closing position. In this state, the air in the ink passage 47*a*-47*d* is discharged to the air chamber 49 through the air-permeable film 60, but the ink in the ink passage 47*a*-47*d* is not discharged therefrom.

On the other hand, when the internal pressure of the gas discharge passage is lower than the threshold, the force deriving from the difference between the internal pressures of the individual air chamber 64*a*-64*d* and the ink passage 47*a*-47*d* and acting on the shut-off valve 69 is greater than the force with which the spring 70 presses the shut-off valve 69, and the shut-off valve 69 is placed in the opening position. In this state, the air in the ink passage 47*a*-47*d* is discharged to the air chamber 49 through the air-permeable film 60, as well as the ink with the increased viscosity in the ink passage 47*a*-47*d* is discharged to the individual air chamber 64*a*-64*d* via the through-hole 58*a*-58*d*.

After the sucking of the air by the suction pump 14 from the gas discharge passage, the internal pressure of the air chamber 102 is negative and thus the valve element 104 is sucked by the negative pressure and moves leftward as seen in FIG. 12 until a peripheral portion of the cutoff portion 104*b* is brought into pressing contact with the left wall of the air chamber 101 as seen in FIG. 12. Thus, the clearance between the cutoff portion 104*b* and the left wall of the air chamber 101 is eliminated, that is, the differential pressure valve 9 is closed, and the communication between the air chamber 101 and the communication passage 103 and air chamber 102 is disconnected. At this time, a portion of the gas discharge passage between the differential pressure valve 9 and the air-permeable film 60 is disconnected from the external and airtight.

Thus, the internal pressure of the portion of the gas discharge passage between the differential pressure valve 9 and the air-permeable film 60 is held negative. Hence, even after termination of sucking of the air from the gas discharge passage by the suction pump 14, the air in the ink passage 47*a*-47*d* is sucked by the negative pressure and discharged to the gas discharge passage.

When the ink in the ink passage 47*a*-47*d* has been discharged to the gas discharge passage via the through-hole 58*a*-58*d*, and immediately after the sucking of the air from the gas discharge passage by the suction pump 14 is terminated, the internal pressure of the gas discharge passage is lower than the threshold and the shut-off valve 69 is continuously held in the opening position, whereby the discharge of the ink from the ink passage 47*a*-47*d* to the individual air chamber 64*a*-64*d* via the through-hole 58*a*-58*d* is continued.

However, after the sucking of the air from the gas discharge passage by the suction pump is terminated, the internal pressure of the gas discharge passage increases as the discharge of the ink from the ink passage 47*a*-47*d* to the gas discharge passage continues. When the internal pressure of the individual air chamber 64*a*-64*d* ultimately increases to a level equal to or higher than the threshold, the force deriving from the difference between the internal pressures of the individual air chamber 64*a*-64*d* and the ink passage 47*a*-47*d* and acting on the shut-off valve 69 becomes equal to or smaller than the force with which the spring 70 presses the shut-off valve 69, the shut-off valve 69 is placed in the closing position.

It is noted that even in this state the internal pressure of a portion of the gas discharge passage on the side of the sub tank 4 with respect to the differential pressure valve 9 is still held at a negative pressure equal to or higher than the threshold, whereby the air in the ink passage 47*a*-47*d* is discharged to the air chamber 49 through the air-permeable film 60.

In this case, too, since the partition wall 59 is disposed, the ink flowing into the individual air chamber 64*a*-64*d* does not tend to flow to the air chamber 49, and even when the ink flows into the air chamber 49, the ink drops or falls to the bottom of the air chamber 49 and does not tend to adhere to the left surface as seen in FIGS. 4A-4D of the air-permeable film 60 or the piece of the unwoven material 55. Even when the ink adheres to and is absorbed by the piece of the unwoven material 55, an amount of the ink thus adhering to the piece of the unwoven material 55 is so small that a possibility that the electrodes 56, 57 are electrically conducted with each other via the ink absorbed by the piece of the unwoven material 55 and it is erroneously detected that an ink leakage occurs at the air-permeable film 60 is negligible.

As described above, according to the differential pressure valve 9 of the present embodiment, when the internal pressure of the portion of the gas discharge passage between the valve element 104 and the sub tank 4 is sufficiently smaller than the internal pressure of the portion of the gas discharge passage between the valve element 104 and the suction pump 14, in other words, when the former pressure is smaller than the latter pressure by more than a predetermined amount, communication between the two portions of the gas discharge passage is disconnected. On the other hand, when that is not the case, that is, when the former pressure is smaller than the latter pressure by an amount smaller than the predetermined amount, when the former and latter pressures are equal to each other, or when the latter pressure is smaller than the former pressure, communication between the two portions of the gas discharge passage is established. The differential pressure valve of the present embodiment is a check valve that allows flow of the air from the sub tank 4 to the suction pump 14, and does not allow flow of the air from the suction pump 14 to the sub tank 4.

When the air flows from the ink passages 47*a*-47*d* to the inkjet head 3, the ink ejection performance of the printer 1 or characteristics of ejection of the inks from the nozzles 95 may undesirably vary. According to the embodiment, however, the air in the ink passages 47*a*-47*d* is discharged to the gas discharge passage as described above, the variation in the ink ejection performance is prevented.

Figure 13A:
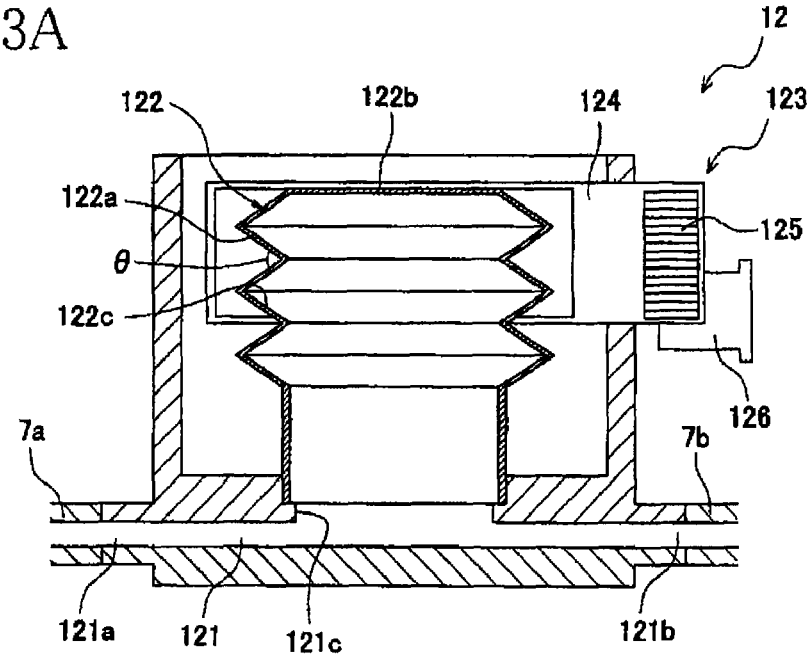
FIGS. 13A and 13B are cross-sectional views of a charge tank shown in FIG. 1.
Figure 13B:
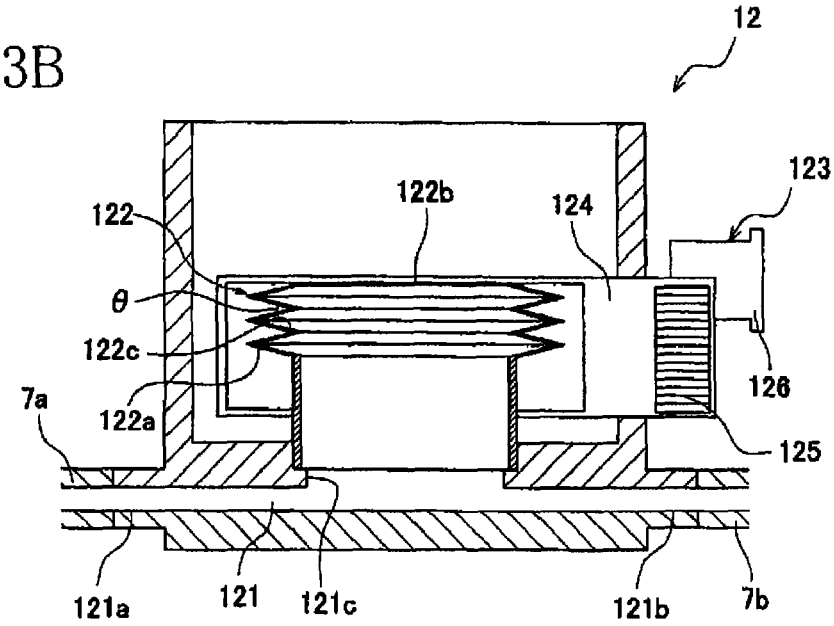

There will be described the charge tank 12, by referring to FIGS. 13A and 13B, which are cross-sectional views of the charge tank 12. FIG. 13A shows a case where the internal pressure of a charge chamber 122*c* (described later) is at the atmospheric pressure, and FIG. 13B shows a case where the internal pressure of the charge chamber 122*c* is negative. As shown in FIGS. 13A and 13B, the charge tank 12 includes an air passage 121, a bellows portion 122, and a pressure detector 123.

The air passage 121 extends in a left-right direction as seen in FIGS. 13A and 13B, and has communication openings 121*a* and 121*b* at left and right ends thereof. The communication openings 121*a*, 121*b* are communicated with the air tubes 7*a*, 7*b*, respectively. The air passage 121 further includes a communication opening 121*c* disposed at an upper side of a substantially central portion of the air passage 121 as seen in FIGS. 13A and 13B. At the communication opening 121*c*, the air passage 121 is communicated with the charge chamber 122*c* (described later) of the bellows portion 122.

The bellows portion 122 extends vertically as seen in FIGS. 13A and 13B, and has the charge chamber 122*c* defined inside thereof by a ceiling wall 122*b* and a side wall 122*a*. The ceiling wall 122*b* defines an upper surface of the charge chamber 122*c*, and is substantially circular in plan view. The side wall 122*a* defines a side surface of the charge chamber 122*c*, and extends from an edge of the ceiling wall 122*a* such that the side wall 122*a* is folded vertically alternately outward and inward of the charge chamber 122*c*. When a vertical force is imposed on the ceiling wall 122*b*, the ceiling wall 122*b* is displaced in a vertical direction, as well as a fold angle θ of the side wall 122*a* changes. This results in a change in the inner volume of the charge chamber 122*c*. The charge chamber 122*c* is open at its lower end, where the charge chamber 122*c* is connected with the communication opening 121*c*. Thus, the air passage 121 and the charge chamber 122*c* (or the gas discharge passage) are communicated with each other.

While the internal pressure of the charge chamber 122*c* is atmospheric, the ceiling wall 122*b* is at its highest position and the fold angle θ of the side wall 122*a* takes the largest value that the side wall 122*a* can take, as shown in FIG. 13A. When the air is sucked from the gas discharge passage by the suction pump 14 in this state, the internal pressure of the charge chamber 122*c* decreases and accordingly a downward force acts on the ceiling wall 122*b* due to a difference between the internal pressure of the charge chamber 122*c* and the external pressure of the charge chamber, i.e., the atmospheric pressure. Hence, the ceiling wall 122*b* is downward displaced and the fold angle θ of the side wall 122*a* decreases as shown in FIG. 13B. With such a deformation of the bellows portion 122, the inner volume of the charge chamber 122*c* decreases.

When the fold angle θ of the side wall 122*a* decreases from the level shown in FIG. 13A, a reaction force acting upward as seen in FIG. 13S occurs at the side wall 122*a* to restore the side wall 122*a* to the state shown in FIG. 13A. As the fold angle θ of the side wall 122*a* decreases from the level shown in FIG. 13A, the reaction force increases. The change in the inner volume of the charge chamber 122*c* in the bellows portion 122 stops when the force resulting from the difference between the internal and external pressures of the charge chamber 122*c* and the reaction force come to equilibrium. Thus, the internal pressure of the charge chamber 122*c* and the inner volume of the charge chamber 122*c* are in a correlationship, that is, the inner volume of the charge chamber 122*c* decreases with the internal pressure of the charge chamber 122*c*.

On the other hand, when the air in the ink passages 47*a*-47*d* is discharged to the individual air chambers 64*a*-64*d* through the air-permeable film 60 while the internal pressure of the charge chamber 122*c* is held negative as shown in FIG. 13B, the internal pressure of the charge chamber 122*c* that is in communication with the individual air chambers 64*a*-64*d* increases. This decreases the force resulting from the difference between the internal and external pressures of the charge chamber 122*c*, and accordingly the ceiling wall 122*b* of the bellows portion 122 is displaced upward with the fold angle θ of the side wall 122*a* increased. When the bellows portion 122 deforms in this way, the inner volume of the charge chamber 122*c* increases.

Since the charge chamber 122*c* is in communication with the gas discharge passage, a sum of an inner volume of the gas discharge passage and an inner volume of the charge chamber 122*c* is larger than the inner volume of the gas discharge passage in the case where the charge tank 12 is not employed, by an amount corresponding to the inner volume of the charge chamber 122*c*. This is effective to reduce a rate of the increase in the internal pressure of the gas discharge passage at the time when the air flows into the gas discharge passage from the ink passages 47*a*-47*d*, and to accordingly prolong a time during which the internal pressure of the gas discharge passage can be held negative.

It is to be understood that when the air flows out of the ink passages 47*a*-47*d* into the gas discharge passage and the inner volume of the charge chamber 122*c* increases, the change or increase in the inner volume of the charge chamber 122*c* stops when the force deriving from the difference between the internal and external pressures of the charge chamber 122*c* and the reaction force from the side wall 122*a* of the bellows portion 122 come to equilibrium, in the same way as in the case of sucking the air from the gas discharge passage by the suction pump 14. That is, the internal pressure of the charge chamber 122*c* and the inner volume of the charge chamber 122*c* are in the correlationship in this case, too.

The pressure detector 123 includes a movable portion 124, a plurality of slits 125, and a slit detecting sensor 126. The movable portion 124 is vertically movable with the ceiling wall 122*b* of the bellows portion 122. As seen in FIGS. 13A and 13B, the slits 125 are disposed at a right end of the movable portion 124 and arranged in a vertical direction, and each of the slits 125 extends in a lateral direction. The slit detecting sensor 126 detects each slit 125 vertically passing by the slit detecting sensor 126. Since the slits 125 vertically move with the ceiling wall 122*b* and the slit detecting sensor 126 detects passing of the slits 125 by the slit detecting sensor 126, the inner volume of the charge chamber 122*c* is detectable.

As described above, the position of the ceiling wall 122*b*, or the inner volume of the charge chamber 122*c*, and the internal pressure of the charge chamber 122*c* are in a correlationship. On the other hand, the pressure detector 123 has the slit detecting sensor 126 that detects that the slits 125 disposed in the movable portion 124 vertically moving with the ceiling wall 122*b* pass by the slit detecting sensor 126. Hence, the pressure detector 123 can detect the internal pressure of the charge chamber 122*c*.

Since the internal pressure of the gas discharge passage is detectable, it is possible to freely change the inner pressure of the gas discharge passage by controlling the operation of the suction pump 14 based on the internal pressure detected by the pressure detector 123.

Figure 14:
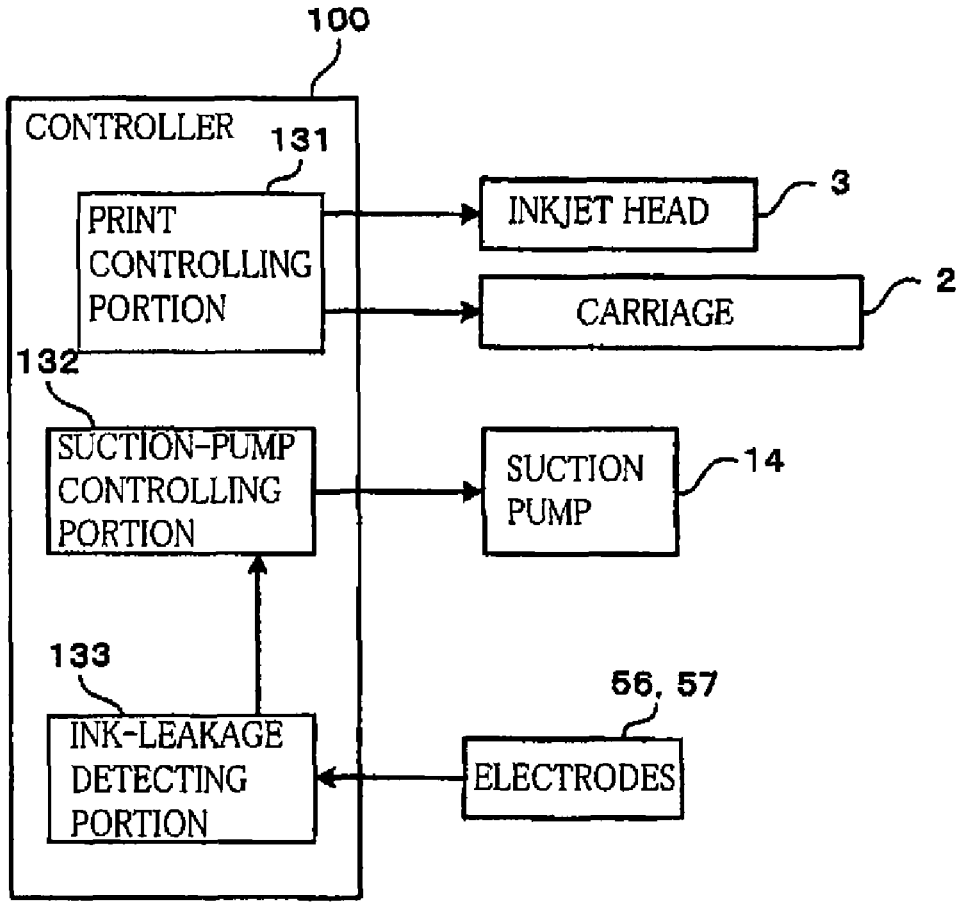
FIG. 14 is a block diagram of a controller of the printer shown in FIG. 1.
Figure 15:
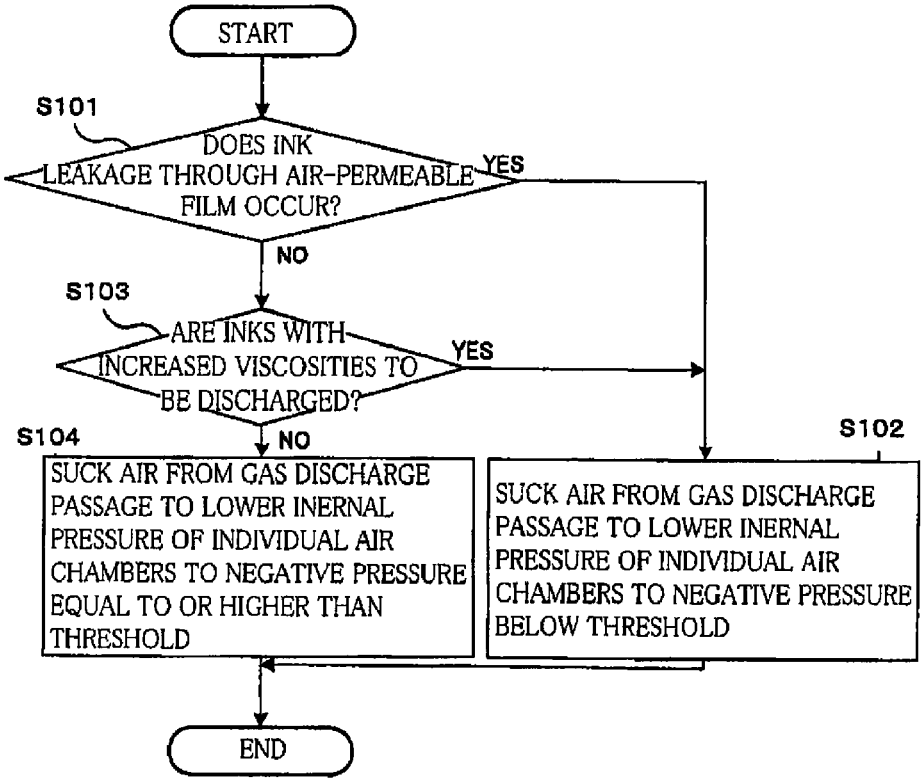
FIG. 15 is a flowchart illustrating a process of sucking a gas or air from a gas discharge passage by means of a suction pump.
Figure 16C:
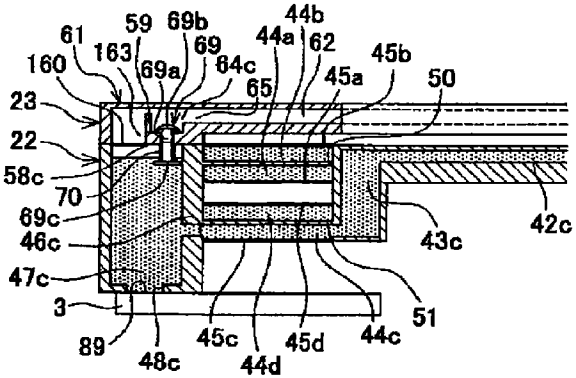
FIGS. 16A-16D show a modification of the embodiment and correspond to FIGS. 4A-4D.
Figure 16D:
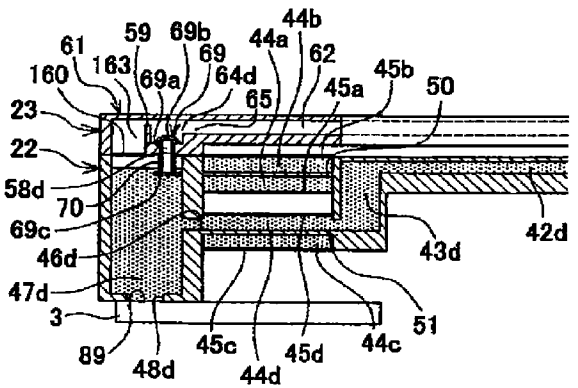
Figure 16A:
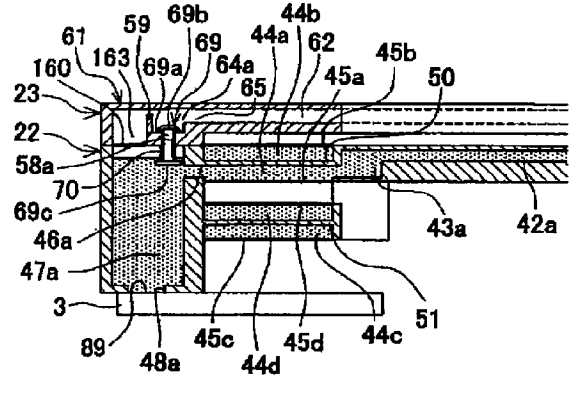
Figure 16B:
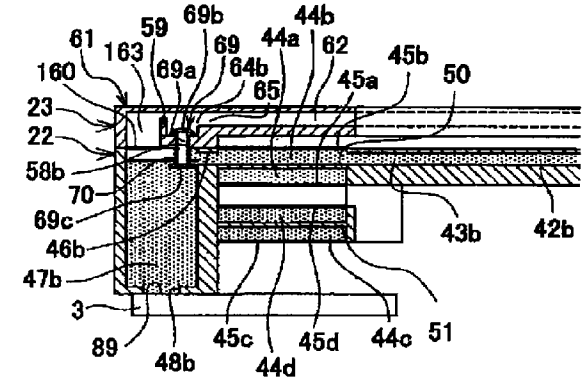

There will be described the controller 100 by referring to FIGS. 14 and 15. FIG. 14 is a block diagram of the controller 100 shown in FIG. 1. As shown in FIG. 14, the controller 100 includes a print controlling portion 131, a suction-pump controlling portion 132, and an ink-leakage detecting portion 133. The print controlling portion 131 controls operations of the inkjet head 3 and the carriage 2 when recording is performed. The suction-pump controlling portion 132 controls an operation of the suction pump 14 when the suction pump 14 sucks the air from the gas discharge passage.

More specifically, when the air is to be sucked from the gas discharge passage but the inks are not to be discharged from the ink passages 47*a*-47*d*, the suction-pump controlling portion 132 controls the suction pump 14 such that the internal pressure of the gas discharge passage becomes a negative pressure equal to or higher than the threshold. In this case, the air in the ink passages 47*a*-47*d* is discharged to the air chamber 49 through the air-permeable film 60.

On the other hand, when the inks in the ink passages 47*a*-47*d* are to be discharged through the gas discharge passage, the suction-pump controlling portion 132 controls the suction pump 14 such that the internal pressure of the gas discharge passage becomes a negative pressure lower than the threshold.

The ink-leakage detecting portion 133 detects a leakage of an ink at the air-permeable film 60, by detecting electrical conduction between the electrodes 56 and 57 that is established when an ink in any of the ink passages 47*a*-47*d* leaks into the air chamber 49 through the air-permeable film 60, as described above Where an ink leakage through the air-permeable film 60 occurs, the air-permeability of the air-permeable film 60 is deteriorated. In this case, when the suction pump 14 sucks the air from the gas discharge passage, very little ink is discharged from the ink passages 47*a*-47*d* to the air chamber 49 through the air-permeable film 60.

Hence, when the ink-leakage detecting portion 133 has detected an ink leakage through the air-permeable film 60, the suction-pump controlling portion 132 controls the suction pump 14 such that while the suction pump 14 sucks the air from the gas discharge passage, the internal pressure of the individual air chambers 64*a*-64*d* is held lower than the threshold to hold the shut-off valve 69 opened and discharge the air along with the inks from the ink passages 47*a*-47*d* to the gas discharge passage via the through-holes 58*a*-58*d*.

There will be described a process of sucking the air from the gas discharge passage by the suction pump 14, by referring to FIG. 15 which is a flowchart illustrating the process.

The flow of the process implemented when the air in the gas discharge passage is to be sucked by the suction pump 14 begins with step S101 to determine whether the ink-leakage detecting portion 133 detects an ink leakage at the air-permeable film 60. When an ink leakage is detected, an affirmative decision (YES) is made in step S101, and the process flow goes to step S102 in which the suction pump 14 is operated to suck the air from the gas discharge passage so as to lower the internal pressure of the individual air chambers 64*a*-64*d* to a negative pressure lower than the threshold. As a result, the shut-off valve 69 is placed in the open state and the air in the ink passages 47*a*-47*d* is discharged along with the inks to the individual air chambers 64*a*-64*d* via the through-holes 58*a*-58*d*.

On the other hand, when an ink leakage is not detected and a negative decision (NO) is made in step S101, the process flow goes to step S103 in which it is determined whether the inks whose viscosities have increased and which are in the ink passages 47*a*-47*d* are to be discharged therefrom. When the inks are to be discharged from the ink passages 47*a*-47*d*, an affirmative decision (YES) is made in step S103, and the process flow goes to the step S102 described above to discharge the inks with the increased viscosities which are in the ink passages 47*a*-47*d* to the individual air chambers 64*a*-64*d* or the gas discharge passage via the through-holes 58*a*-58*d*.

When the inks are not to be discharged from the ink passages 47*a*-47*d*, a negative decision (NO) is made in step S103, and the process flow goes to step S104 in which the suction pump 14 is operated to suck the air from the gas discharge passage so as to lower the internal pressure of the individual air chambers 64*a*-64*d* to a negative pressure equal to or higher than the threshold. As a result, the air in the ink passages 47*a*-47*d* is discharged through the air-permeable film 60 to the air chamber 49 or the gas discharge passage while the shut-off valves 69 are held in the closing state and thus the inks in the ink passages 47*a*-47*d* are not discharged to the gas discharge passage.

According to the embodiment, when the suction pump 14 sucks the air from the gas discharge passage to lower the internal pressure of the individual air chambers 64*a*-64*d* below the threshold, the shut-off valves 69 are placed in the open state and the inks with the increased viscosities which are in the ink passages 47*a*-47*d* are discharged through the gas discharge passage. Since the inks with the increased viscosities are discharged without passing through the nozzles 95 at this time, clogging of the nozzles 96 with the inks with increased viscosities is prevented.

On the other hand, when the suction pump 14 sucks the air from the gas discharge passage to lower the internal pressure of the individual air chambers 64*a*-64*d* to a level equal to or higher than the threshold, the shut-off valves 69 are placed in the closing state and the inks in the ink passages 47*a*-47*d* are not discharged to the gas discharge passage, but the air in the ink passages 47*a*-47*d* is discharged through the air-permeable film 60 to the air chamber 49.

The sub tank 4 constituting a part of the liquid supply passage is larger in dimensions than the tubes 5*a*-5*d* constituting another part of the liquid supply passage. Hence, by connecting the liquid supply passage and the gas discharge passage with each other in the sub tank 4 at two different places, and disposing the air-permeable film 60 and the shut-off valves 69 at the two different places, respectively, the dimensions of the air-permeable film 60 and the shut-off valves 69 can be made large as compared to the case where the air-permeable film and the shut-off valves are disposed in the tubes 5*a*-5*d* or other portions of the liquid supply passage than in the sub tank 4. Thus, the inks with the increased viscosities and the air in the liquid supply passage are further efficiently discharged to the gas discharge passage.

In the liquid supply passage, the sub tank 4 has an inner volume larger than that of the other portions of the liquid supply passage. Hence, the sub tank 4 contains a larger amount of the air and the inks with the increased viscosities than the other portions of the liquid supply passage. Further, since the inks whose viscosities have increased due to evaporation of water therefrom through the walls of the tubes 5*a*-5*d* and/or for other reasons flow into the sub tank 4, the amounts of the inks contained in the sub tank 4 further increase. Hence, by disposing the air-permeable film 60 and the shut-off valves 69 in the sub tank 4 as described above, the air and the inks with the increased viscosities that are in the liquid supply passage are efficiently discharged therefrom.

The shut-off valves 69 are placed in the open state and the closing state by sucking the air from the gas discharge passage by the suction pump 14, such that the internal pressure of the individual air chambers 64*a*-64*d* is lowered to a level below the threshold, and to a level equal to or higher than the threshold, respectively. Hence, the printer 1 of the embodiment does not require a device or means for switching the state of the shut-off valves 69 between the open state and the closing state, and is accordingly simple in structure.

Where an ink leakage through the air-permeable film 60 occurs and the air in the ink passages 47*a*-47*d* is to be discharged, the shut-off valves 69 are placed in the open state and the air in the ink passages 47*a*-47*d* is discharged along with the inks in the ink passages 47*a*-47*d*, to the individual air chambers 64*a*-64*d* via the through-holes 58*a*-58*d*. Hence, even where the air-permeability of the air-permeable film 60 is so deteriorated that it becomes impossible to sufficiently discharge the air in the ink passages 47*a*-47*d* to the air chamber 49 through the air-permeable film 60, the air in the ink passages 47*a*-47*d* can be discharged to the gas discharge passage.

Since the shut-off valves 69 are disposed in a plane different from a plane in or along which the air-permeable film 60 extends, the dimension of the sub tank 4 in the left-right direction as seen in FIGS. 4A-4D is relatively small.

In the gas discharge passage, the individual air chambers 64*a*-64*d* where the shut-off valves 69 are disposed are on the side of the suction pump 14 with respect to the air chamber 49 where the air-permeable film 60 is disposed. Hence, when the inks in the ink passages 47*a*-47*d* are discharged to the gas discharge passage, the inks do not flow from the individual air chambers 64*a*-64*d* toward the air chamber 49, whereby it is prevented that the inks adhere to the left surface as seen in FIGS. 4A-4D of the air-permeable film 60, i.e., the surface of the air-permeable film 60 on the side opposite to the ink passages 47*a*-47*d*.

Since the partition wall 59 is disposed between the communication passage 63 communicated with the air chamber 49 where the air-permeable film 60 is disposed, and the individual air chambers 64*a*-64*d* where the shut-off valves 69 are disposed, it is effectively prevented that the inks in the individual air chambers 64*a*-64*d* flow into the air chamber 49.

In addition, since the air-permeable film 60 vertically extends, even when some amount of any of the inks flows into the air chamber 49 from the individual air chambers 64*a*-64*d*, the ink flowing into the air chamber 49 drops or falls to the bottom of the air chamber 49. Thus, the air-permeable film 60 does not tend to be contaminated with the inks.

Although there has been described one embodiment of the invention, it is to be understood that the invention is not limited to the details of the embodiment, but may be otherwise embodied with various modifications and improvements that may occur to those skilled in the art, without departing from the scope and spirit of the invention defined in the appended claims.

For instance, FIGS. 16A-16D show one modification of the embodiment. There will be described the modification by referring to FIGS. 16A-16D. Parts or elements corresponding to those in the above-described embodiment are denoted by the same reference numerals as used in the embodiment, and description thereof is omitted.

As shown in FIGS. 16A-16D, the modification employs an air-permeable film 160 in place of the air-permeable film 60. The air-permeable film 160 horizontally extends on the upper surfaces of the ink passages 47*a*-47*d* and on the left side of the shut-off valves 69. That is, the shut-off valves 69 and the air-permeable film 160 are disposed in a same plane, and the air-permeable film 160 does not extend vertically, unlike the air-permeable film 60 of the embodiment shown in FIGS. 4A-4D. Over the air-permeable film 160, and to the immediate left as seen in FIGS. 16A-16D of the individual air chambers 64*a*-64*d*, an air chamber 163 is disposed. The air chamber 163 is in communication with the ink passages 47*a*-47*d* via the air-permeable film 160, as well as with the individual air chambers 64*a*-64*d*. Between the air chamber 163 and the individual air chambers 64*a*-64*d*, the partition wall 59 is disposed.

Similar to the embodiment, when the internal pressure of the individual air chambers 64*a*-64*d* is equal to or higher than the threshold, the shut-off valves 69 are placed in the closing state, and the air in the ink passages 47*a*-47*d* is discharged to the air chamber 163 through the air-permeable film 160. When the internal pressure of the individual air chambers 64*a*-64*d* is lower than the threshold, the shut-off valves 69 are placed in the open state, whereby the inks in the ink passages 47*a*-47*d* are discharged to the individual air chambers 64*a*-64*d* (or the gas discharge passage) via the through-holes 58*a*-58*d*.

In this modification, too, each of the shut-off valves 69 is disposed in the gas discharge passage on the side of the suction pump 14 with respect to the air-permeable film 160, and thus when the inks are discharged to the gas discharge passage, the inks do not tend to flow to the air chamber 163 from the individual air chambers 64*a*-64*d*. Further, since the partition wall 59 is disposed between the individual air chambers 64*a*-64*d* and the air chamber 163, the inks discharged to the individual air chambers 64*a*-64*d* do not tend to further flow into the air chamber 163.

Other modifications of the embodiment will be described.

Although in the above-described embodiment the partition wall 59 is disposed between the communication passage 63 and the individual air chambers 64*a*-64*d*, the partition wall 59 may be omitted. In the case where the partition wall 59 is not employed, the individual air chambers 64*a*-64*d* are disposed in the gas discharge passage on the side of the suction pump 14 with respect to the air chamber 49, and therefore when the suction pump 14 sucks the inks whose viscosities have increased and which are in the ink passages 47*a*-47*d*, the inks are discharged to the individual air chambers 64*a*-64*d*, and then tend to flow into the common air chamber 65 and do not tend to flow into the air chamber 49. Thus, the inks do not tend to adhere to the air-permeable film 60.

In the above-described embodiment, the shut-off valves 69 are disposed in the gas discharge passage on the side of the suction pump 14 with respect to the air-permeable film 60. However, the air-permeable film 60 may be disposed in the gas discharge passage on the side of the suction pump 14 with respect to the shut-off valves 69. In the case where the air-permeable film 60 is disposed on the side of the suction pump 14 with respect to the shut-off valves 69, when the inks are discharged to the gas discharge passage, the inks adhere to the air-permeable film 60. However, even when the inks adhere to the air-permeable film 60, the air-permeability of the air-permeable film 60 is not immediately deteriorated, and the inks whose viscosities have increased and which are in the sub tank 4 can be discharged through the shut-off valves 69 and the air in the sub tank 4 can be discharged to the gas discharge passage through the air-permeable film 60, in the same way as in the embodiment.

Although in the embodiment the gas discharge passage is connected with the liquid supply passage at two different places in the sub tank 4, this is not essential. That is, the gas discharge passage may be connected with each of the liquid supply passages (e.g. the tubes 5*a*-5*d*) at two different places, at one of which an air-permeable film is disposed and at the other of which a shut-off valve is disposed.

According to the embodiment, the piece of the unwoven material 55 is disposed on the surface of the air-permeable film 60 on the side of the air chamber 49 and the electrodes 56, 57 are disposed on the surface of the piece of the unwoven material 55 opposite to the air-permeable film 60 so that when any of the inks leaks through the air-permeable film 60, the ink is absorbed by, and spreads over the entirety of, the piece of the unwoven material 55 and the electrodes 56 and 57 are electrically conducted with each other via the absorbed ink, whereby it is detectable that the ink leakage through the air-permeable film 60 occurs. However, an ink leakage through the air-permeable film 60 may be detected in other ways.

Alternatively, the printer 1 may not include a device or means for detecting an ink leakage through the air-permeable film 60. In the printer 1 not including such a device or means, in a case where the air-permeable film 60 is clogged and the air-permeability thereof is deteriorated, even when the shut-off valves 69 are placed in the closing position to discharge the air in the ink passages 47*a*-47*d* through the air-permeable film 60 to the air chamber 49, the air cannot be discharged sufficiently from the ink passages 47*a*-47*d*. However, when the shut-off valves 69 are placed in the opening position and the inks with the increased viscosities which are in the ink passages 47*a*-47*d* are discharged to the individual air chambers 64*a*-64*d* via the through-holes 58*a*-58*d*, the air in the ink passages 47*a*-47*d* is also discharged to the individual air chambers 64*a*-64*d*. Hence, the air does not remain in the ink passages 47*a*-47*d*.

According to the embodiment, the shut-off valves 69 are placed in the closing position when the internal pressure of the individual air chambers 64*a*-64*d* is equal to or higher than the threshold, and are placed in the opening position when the internal pressure of the individual air chambers 64*a*-64*d* is lower than the threshold. That is, the shut-off valves 69 operate in relation to the internal pressure of the gas discharge passage. However, this is not essential. A shut-off valve operable independently of the internal pressure of the gas discharge passage, e.g., solenoid valve, may be employed in place of the shut-off valve 69.

Where a shut-off valve operable independently of the internal pressure of the gas discharge passage is employed, the shut-off valve is placed in the open state only when the inks with the increased viscosities are to be discharged from the ink passages 47*a*-47*d*, and is held in the closing position otherwise.

According to the embodiment, a differential pressure valve 9 that opens while the suction pump 14 sucks the air from the gas discharge passage and closes while the suction pump 14 does not suck the air from the gas discharge passage is disposed in the gas discharge passage. However, in place of the differential pressure valve 9, a valve operable independently of an operating state of the suction pump 14, e.g., solenoid valve, may be employed.

Although in the embodiment the invention is applied to a printer performing printing or recording by ejecting ink droplets from the nozzles, the invention is equally applicable to a liquid ejecting apparatus having a nozzle and ejecting a liquid other than ink from the nozzle.

What is claimed is:

1. A liquid ejecting apparatus comprising:

a liquid ejecting head having a nozzle and ejecting a liquid from the nozzle;

a liquid supply passage which is connected with the liquid ejecting head, and through which the liquid is supplied to the liquid ejecting head;

a gas discharge passage which is connected with the liquid supply passage at two different places, and through which a gas in the liquid supply passage is discharged;

a gas-permeable film which is disposed at one of the two different places and constitutes a wall which separates the liquid supply passage and the gas discharge passage from each other, the gas-permeable film allowing gases to pass therethrough but not allowing liquids to pass therethrough;

a shut-off valve which is disposed at the other of the two different places, and selectively placeable in an open position to communicate the liquid supply passage and the gas discharge passage with each other and a closing position to disconnect the communication between the liquid supply passage and the gas discharge passage; and a sucking device which lowers an internal pressure of the gas discharge passage by sucking the gas from the gas discharge passage, wherein the shut-off valve is constituted by a differential pressure valve which is displaced between the closing position and the opening position by a force deriving from a difference between the internal pressure of the liquid supply passage and the internal pressure of the gas discharge passage, wherein the differential pressure valve is placed in the closing position when the internal pressure of the gas discharge passage is equal or higher than a threshold, and wherein the differential pressure valve is placed in the opening position when the internal pressure of the gas discharge passage is lower than the threshold.

2. A liquid ejecting apparatus according to claim 1, wherein the liquid supply passage is connected with the liquid ejecting head, and includes a liquid storage tank for temporarily storing the liquid that is to be supplied to the liquid ejecting head, and wherein the two different places are disposed in the liquid storage tank.

3. A liquid ejecting apparatus according to claim 2, wherein a portion of the liquid supply passage upstream of the liquid storage tank is constituted by a tube.

4. A liquid ejecting apparatus according to claim 1, wherein the shut-off valve is disposed in the gas discharge passage on the side of the sucking device with respect to the gas-permeable film.

5. A liquid ejecting apparatus according to claim 4, further comprising a liquid-inflow inhibiting wall disposed in the gas discharge passage and between the gas-permeable film and the shut-off valve, the liquid-inflow inhibiting wall inhibiting the liquid from flowing into a portion of the gas discharge passage in which the gas-permeable film is disposed from another portion of the gas discharge passage in which the shut-off valve is disposed.

6. A liquid ejecting apparatus according to claim 1, wherein a plane along which the gas-permeable film extends and a plane in which the shut-off valve is disposed differ from each other.

7. A liquid ejecting apparatus according to claim 1, wherein the gas-permeable film extends vertically.

8. A liquid ejecting apparatus according to claim 1, wherein the liquid ejecting head ejects the liquid in the form of droplets.

9. A liquid ejecting apparatus according to claim 1, wherein the liquid ejecting head has a plurality of the nozzles, the liquid ejecting apparatus performing recording on a recording medium by ejecting an ink as the liquid from the nozzles onto the recording medium opposed to the liquid ejecting head.

10. A liquid ejecting apparatus comprising:

a liquid ejecting head having a nozzle and ejecting a liquid from the nozzle;

a liquid supply passage which is connected with the liquid ejecting head, and through which the liquid is supplied to the liquid ejecting head;

a gas discharge passage which is connected with the liquid supply passage at two different places, and through which a gas in the liquid supply passage is discharged;

a gas-permeable film which is disposed at one of the two different places and constitutes a wall which separates the liquid supply passage and the gas discharge passage from each other, the gas-permeable film allowing gases to pass therethrough but not allowing liquids to pass therethrough;

a shut-off valve which is disposed at the other of the two different places, and selectively placeable in an open state to communicate the liquid supply passage and the gas discharge passage with each other and a closing state to disconnect the communication between the liquid supply passage and the gas discharge passage;

a sucking device which lowers an internal pressure of the gas discharge passage by sucking the gas from the gas discharge passage, wherein the shut-off valve is constituted by a differential pressure valve which is placed in the closing state when the internal pressure of the gas discharge passage is equal to or higher than a threshold, and placed in the open state when the internal pressure of the gas discharge passage is lower than the threshold, and wherein the liquid ejecting apparatus further comprises a liquid-leakage detector which detects a leakage of the liquid from the liquid supply passage to the gas discharge passage through the gas-permeable film, and wherein when the liquid-leakage detector detects the leakage of the liquid, the sucking device sucks the gas in the gas discharge passage so as to lower the internal pressure of the gas discharge passage below the threshold to place the shut-off valve in the open state.

* * * * *